US006435851B2

(12) United States Patent
Mallen

(10) Patent No.: US 6,435,851 B2
(45) **Date of Patent: *Aug. 20, 2002**

(54) VANE PUMPING MACHINE UTILIZING INVAR-CLASS ALLOYS FOR MAXIMIZING OPERATING PERFORMANCE AND REDUCING POLLUTION EMISSIONS

(75) Inventor: Brian D. Mallen, Charlottesville, VA (US)

(73) Assignee: Mallen Research Ltd., Partnership, Charlottesville, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/737,775

(22) Filed: Dec. 18, 2000

Related U.S. Application Data

(63) Continuation-in-part of application No. 09/258,791, filed on Mar. 1, 1999, now Pat. No. 6,162,034.

(51) Int. Cl.[7] ..... F01C 1/344; F04C 3/344
(52) U.S. Cl. ..... 418/178; 418/179; 418/265
(58) Field of Search ..... 418/718, 179, 418/235, 259, 260, 265

(56) References Cited

U.S. PATENT DOCUMENTS

| | | | | |
|---|---|---|---|---|
| 315,318 A | | 1/1885 | Moffet | 418/260 |
| 1,050,905 A | | 1/1913 | Baade | 418/265 |
| 1,716,901 A | | 6/1929 | Rochford | 418/235 |
| 1,743,539 A | | 1/1930 | Gasal | 418/265 |
| 3,485,179 A | | 12/1969 | Dawes | 418/265 |
| 4,237,845 A | | 12/1980 | Kato et al. | 123/271 |
| 4,529,445 A | | 7/1985 | Buschow | 75/123 |
| 4,640,125 A | | 2/1987 | Carpenter | 418/178 |
| 4,707,416 A | | 11/1987 | Ebata et al. | 428/627 |
| 4,853,298 A | | 8/1989 | Harner et al. | 428/630 |
| 4,904,447 A | | 2/1990 | Handa | 420/95 |
| 5,403,547 A | | 4/1995 | Smith et al. | 420/581 |
| 5,476,633 A | | 12/1995 | Sokolowski et al. | 419/57 |
| 5,524,586 A | | 6/1996 | Mallen | 123/219 |
| 5,836,282 A | | 11/1998 | Mallen | 123/219 |
| 6,162,034 A | * | 12/2000 | Mallen | 418/179 |

FOREIGN PATENT DOCUMENTS

| | | | |
|---|---|---|---|
| JP | 60-6092 | 1/1985 | 418/178 |

* cited by examiner

*Primary Examiner*—John J. Vrablik
(74) *Attorney, Agent, or Firm*—Volentine Francos, PLLC

(57) ABSTRACT

A rotary-vane pumping machine has a core structure that includes a stator assembly defining a contoured surface of a stator cavity, a rotor spinning around a rotor shaft axis that is fixed relative to the stator cavity, and end plates disposed on either side of the rotor. The rotor has a plurality of radial vanes slots for housing a corresponding plurality of vanes that slide within the radial vane slot of the rotor. Each of the plurality of vanes has side walls, a tip portion, and a base portion, and the base portion has one or more tabs extending from at least one axial end of the vane. The plurality of vanes, stator cavity, and rotor define a plurality of chamber cells. The core structure is substantially made of low coefficient of thermal expansion Invar materials to achieve precise non-contact sealing clearances between components of the machine.

9 Claims, 13 Drawing Sheets

VANE PUMPING MACHINE UTILIZING INVAR-CLASS ALLOYS FOR MAXIMIZING OPERATING PERFORMANCE AND REDUCING POLLUTION EMISSIONS

This application is a continuation-in-part application of "VANE PUMPING MACHINE UTILIZING INVAR-CLASS ALLOYS FOR MAXIMIZING OPERATING PERFORMANCE AND REDUCING POLLUTION EMISSIONS," by Brian D. Mallen, Ser. No. 09/258,791, filed on Mar. 1, 1999, issued as U.S. Pat. No. 6,162,034 on Dec. 19, 2000, the contents of which are herein incorporated by reference in its entirety.

BACKGROUND OF THE INVENTION

The present invention generally relates to vane pumping machines, and more particularly, to Invar-class iron-nickel based alloys that are used in portions of the vane pumping machine to optimize the operating performance while yielding substantial reductions in the pollution emissions of the machine. The use of Invar-class iron-nickel based alloys ensures that precise clearances are maintained for the non-contact sealing features of the machine described herein.

The overall invention relates to a large class of vane pumping machines comprising all rotary vane (or sliding vane) pumps, compressors, engines, vacuum pumps, blowers, and internal combustion engines.

This class of vane pumping machines includes designs having a rotor with slots with a radial component of alignment with respect to the rotor's axis of rotation, vanes which reciprocate within these slots, and a chamber contour within which the vane tips trace their path as they rotate and reciprocate within their vane slots. In alternate embodiments, the vanes may slide with an axial component of vane motion, or with a vector that includes both axial and radial components. The vanes may also be oriented at any angle in or orthogonal to the plane illustrated, whereby the vanes would also slide with a diagonal motion in addition to any axial or radial components. The vane motion may also have an arcuate component of motion as well. In all cases, the reciprocating vanes extend and retract synchronously with the relative rotation of the rotor and the shape of the chamber surface in such a way as to create cascading cells of compression and/or expansion, thereby providing the essential components of a pumping machine.

Within this class of vane pumping machines are internal combustion engines, which are the focus of the following discussion. Note however that the features and advantages of the later disclosed invention could be applied to any pumping machine.

Typical pollution emissions for internal combustion engines and efforts to reduce such emissions in a particular sliding vane internal combustion engine were described in U.S. Pat. Nos. 5,524,586 and 5,836,282. By way of summary, the oxidation of hydrocarbon fuels at the elevated temperatures and pressures associated with internal combustion engines produce at least three major pollutant types:

(1) Oxides of Nitrogen ($NO_x$);

(2) Oxides of Carbon (CO, $CO_2$); and (3) Hydrocarbons (HC)

Carbon dioxide ($CO_2$) is a non-toxic necessary by-product of the hydrocarbon combustion process and can only be effectively reduced in absolute output by increasing the overall efficiency of the engine for a given application. The other major pollutants, $NO_x$, CO, and HC, contribute significantly to global pollution and are usually the pollutants referred to in engine discussions. Other pollutants, such as aldehydes associated with alcohol fuels and particulate associated with diesel engines, contribute to global pollution as well.

Unfortunately, current production engines are not ideally suited for achieving low pollution emissions within mainstream applications such as automotives. Production engines include piston engines, Wankel rotary engines, and turbine engines, which may be divided into two fundamental categories: positive displacement engines and turbine engines.

In positive displacement engines (piston and Wankel engines) the flow of the fuel-air mixture is segmented into distinct volumes that are completely or almost completely isolated by distinct solid sealing elements (e.g., piston rings in the piston engine and rotor apex seals in the Wankel engine) throughout the engine cycle, creating compression and expansion through physical volume changes within a chamber. In the piston engine, the piston rings, which surround the piston, contact the cylinder block to seal the chamber as the piston reciprocates with the cylinder. In the Wankel engine, the apex seals of the rotor contact the stator housing as the rotor rotates within the stator housing.

Turbine engines, on the other hand, rely on fluid inertia effects to create compression and expansion, without solidly isolating chambers of the fuel-air mixture. Turbine engines, in most applications, offer three advantageous pollution emission-reducing features:

(1) lower peak combustion temperatures;

(2) extended combustion duration; and (3) leaner fuel-air ratio.

Because of these three features, pollution emissions of $NO_x$, CO, and HC are normally lower in a turbine engine than in a piston or Wankel engine. The significantly lower peak combustion temperatures—largely provided by the leaner fuel-air ratio—reduce $NO_x$, emissions by reducing the rate of formation of $NO_x$, while the extended combustion duration and leaner fuel-air ratio reduce CO and HC emissions through oxidation of these compounds. Some turbine engines incorporate a sophisticated "Double-Cone" burner, or other such mixing devices, to allow adequate premixing of fuel and air prior to combustion, which is important to reducing $NO_x$ emissions.

Turbine engines, however, are not practical for most mainstream applications (e.g., automobiles) because of high cost, poor partial power performance, and/or low efficiency at small sizes, leaving positive displacement engines, such as the piston and Wankel designs, as the only practical alternative for these mainstream applications.

Unfortunately, commercially available piston and Wankel designs offer poor emissions performance and/or require catalytic converters to reduce emissions. Even with catalytic converters, pollutant output is substantially higher than desired. U.S. Pat. Nos. 5,524,586 and 5,836,282 describe methods of reducing pollution emissions in a positive displacement vane engine toward the scale of the aforementioned advanced turbine engines.

However, even with the above advantages, efforts continue in order to further refine and enhance the performance of the vane machine. Recall that conventional piston and Wankel engines employ contact sealing for the chamber volumes, which requires lubrication within the chambers. Such lubrication has at least two distinct drawbacks. One drawback is that since the lubricant is in the chamber, a petroleum-based lubricant may itself become a source of pollution, both directly and indirectly, as a by-product of the combustion reaction. The second drawback is that while lubricating the contact interface between two components, the lubricant imposes undesirable temperature limitations on the chamber surface, thereby increasing heat transfer and decreasing fuel efficiency. In other words, given the temperature limits of the lubricant, the chamber surface must be kept cool enough to keep the lubricant below the breakdown temperature of the lubricant.

One means of eliminating the lubricant within the chamber is to eliminate the contact seals and replace them with non-contact or gas seals. In the context of the present invention, the gas seal may be comprised of air, compressed air, fuel-air combinations, combusted fuel-air combinations, and exhaust by-products thereof. Further study of the non-contact sealing clearances in the vane engine design highlights the importance of achieving appropriate sealing performance and reliability. However, to achieve the required non-contact sealing clearances in mainstream applications for optimum performance, the problem of the differential thermal expansion of the machine's components must be addressed and solved.

The measure of a material's susceptibility to thermal expansion is expressed as the coefficient of thermal expansion (CTE), which is the change in length per unit length of material for a one degree Centigrade change in temperature. CTE's are generally expressed as millionths of a centimeter, per centimeter, per degree Centigrade, or parts per million (ppm/° C.). The CTE's of steel and aluminum typically used in pumping machines are generally on the order of 11–20 ppm/° C. The higher the CTE the greater the expansion of the material when placed under thermal load, which would obviously affect the sealing performance, sealing, clearances, and reliability of the pumping machine.

The CTE for a material is especially critical for machine designs employing non-contact sealing clearances, since the non-contact sealing clearance itself is quite small, making the machine's performance quite vulnerable to small temperature changes within the machine.

Invar-class alloys are known to have remarkably low coefficients of thermal expansion (CTE). See, for example, U.S. Pat. Nos. 5,476,633 and 4,529,445. Such Invar-class alloys generally comprise nickel (30%–40%), cobalt (0%–10%) with the remainder being iron (60%–70%). The alloys may also contain small amounts of other elements, such as manganese and silicon, to improve certain properties. See, for example, U.S. Pat. No. 4,904,447.

The two most common alloys are Super Invar and Invar 36. There are other types of Invar alloys, such as stainless steel Invar, and such Invar alloys are considered to be within the scope of the invention described hereafter. For simplicity and ease of discussion, the following description will generally focus on Super Invar and Invar 36. Super Invar generally comprises about 32% nickel (Ni), 5.5% cobalt (Co), with the remainder being iron (Fe). Super Invar has excellent dimensional stability at room temperature, but it is costly compared with other Invar alloys. Invar 36 has more practical applications since it is easier to fabricate and has a low CTE over a wider range of temperatures. Invar 36 comprises about 36% nickel (Ni) with the balance being iron (Fe).

In general, the CTE of Invar 36 can vary, depending on the composition and heat treatment, from −0.6 to +3.00 ppm/° C. in the temperature range of −70° C. to +100° C. In most applications, the rate of thermal expansion is approximately one order of magnitude less than that of carbon steel at temperatures up to 200° C. Invar 36 is used for applications where dimensional changes due to temperature variations must be minimized.

Such Invar-class alloys have been used in precision condenser plates, special joints and washers, thermostatic bimetals, and precision measurement apparatus. However, Invar-class alloys have not been used in all core components of conventional piston, Wankel or turbine engine designs. Rather, Invar-class alloys have been used mostly in portions of the engines where material stresses are low, or in engines where non-contact sealing clearances are not a concern. For example, in one conventional spark-ignition piston engine, Invar-class alloys have been used to line a small channel between a main combustion chamber and an auxiliary combustion chamber, with the small channel being formed in a cylinder head fixed onto the cylinder block. See U.S. Pat. No. 4,237,845.

Invar-class alloys are not typically used throughout conventional piston, Wankel or turbine engines for various reasons. Although Invar-class alloys have lower CTE'S, they are more expensive than conventional engine materials, cannot be used in very high material stress environments, and have significant temperature limitations.

For example, Invar-class alloys are not widely used in Wankel engines because they would not substantially improve the performance of the engine, but at the same time the cost of the engine would increase undesirably. Since the Wankel engine employs contact sealing, the benefits of using a low CTE material to maintain a non-contact seal are unavailing.

Invar-class alloys are also impractical for use throughout piston engines. Again, since piston engines employ contact sealing (i.e., piston rings), the benefits of using a low CTE material to maintain a non-contact seal are unavailing. Moreover, because the power density of the piston engine is so low, the cost of the engine would increase undesirably.

Both the piston and Wankel engines require a lubricant to lubricate the contact seal between the engine components, that is, between the piston rings and the cylinder block in the piston engine, and between the apex seals on the rotor and the stator housing in the Wankel engine. The use of a lubricant undermines the benefits sought in pursuing a non-contact sealing design. More specifically, the advantages of the non-contact sealing design are fourfold: (1) eliminating the pollution-generating oil film; (2) simultaneously raising the wall temperatures beyond the breakdown temperature of the oil to thereby decrease heat transfer and increase fuel efficiency; (3) reducing mechanical friction; and (4) increasing power density by permitting an increase in tangential tip velocities, and thus flow rates.

With regard to turbine engines, the excessive operating temperatures and mechanical stresses encountered in such engines preclude the use of Invar-class alloys to any great extent.

Accordingly, an internal combustion vane engine designed for near-zero pollution and high efficiency requires non-contact sealing to eliminate the need for lubrication in the chambers or vane cells. A need exists, therefore, for a non-contact vane engine geometry, which can employ and successfully exploit such Invar-class low-expansion alloys, such that the vane engine geometry and alloys provide mutual and synergistic benefits. As described hereafter, in the present invention the extremely close clearances for the non-contact sealing are achieved by using Invar-class alloys having a very low coefficient of thermal expansion. Since the unique non-contact engine design of the present invention has low internal stresses, the engine designer is not precluded from employing and exploiting the benefits of the Invar-class alloys. As a result, the low internal stress design of the engine permits the used of the rigid Invar-class alloys, while reducing or eliminating the disadvantages associated with weakness under high material stress conditions. At the same time, the non-contact sealing features of the engine are achieved by exploiting the advantageous low thermal expansion properties of the Invar-class alloys.

Another challenge to employing Invar-class alloys is to design an engine that can successfully use components comprised of the Invar-class alloys, where there is a rolling interface between the Invar component and the other components of the engine. By way of background, if an engine designer sought to employ roller bearings to reduce friction between certain components of the engine as they move relative to each other, the components should be composed of a hard material, such as hardened-steel or carbide. The roller bearings would thus have a hard surface to roll on without causing significant wear to the component. However, Invar-class alloys are relatively soft compared to, for example, the hardened-steel or carbide materials, and components manufactured from such Invar-class alloys would generally be unsuitable for use where a rolling interface is desired. A need thus exists for a vane engine whose major components are comprised of Invar-class alloys, but which employ hard bearing, inserts to provide a suitable rolling surface for the bearings. Such hard bearing, inserts should not, however, significantly alter the low thermal expansion properties of the Invar-class alloys.

SUMMARY OF THE INVENTION

Accordingly, the present invention is directed to a vane pumping machine employing low thermal expansion alloys to achieve precise sealing, clearances in a non-contact sealing design, which substantially overcomes one or more of the problems due to the limitations and disadvantages of the related art.

Specifically, the pumping machine may be a two vane-stroke sliding vane engine, wherein the vanes slide with an axial and/or radial component of vane motion, configured to achieve a low or reduced emissions chemical environment with respect to $NO_x$, CO, and HC emissions. Some means of radially guiding the vanes is provided to ensure near-contact, or close proximity, between the vane tips and chamber surface as the rotor and vanes rotate with respect to the chamber surface.

An object of the invention is to provide a low internal stress design such that the low thermal expansion characteristics of the Invar-class-alloys may be exploited.

Another object of the present invention is to permit non-contact vane tip sealing at an extremely close proximity to the stator by minimizing, thermal expansion of the stator and rotor without incurring noticeable thermal losses and without risking catastrophic failure should temporary contact and abrasions occur.

Another object of the present invention is to provide a non-contact sealing design that requires no lubrication within the vane cells of chambers of the machine to thereby substantially reduce or eliminate pollution-generating oil films and raise chamber wall temperatures, thereby decreasing mechanical friction and increasing fuel efficiency.

Another object of the present invention is to provide an effective means to cool all Invar-class components so that the alloys do not exceed their effective low thermal expansion range.

Another object of the present invention is to employ hard bearing inserts along the surface of the engine components comprised of Invar-class alloys, to provide a suitable rolling surface for roller bearings, for the purpose of maintaining non-contact sealing, proximity, and where the inserts do not significantly alter the low thermal expansion properties of the Invar-class alloys.

To achieve these and other advantages, the present invention provides a rotary vane pumping machine having a core structure and peripheral components interfacing with the core structure. The core structure comprises a stator assembly comprising an annular ring, the inner circumferential surface of the annular ring defining a contoured surface of a stator cavity; a rotor spinning around a rotor shaft axis, the rotor shaft axis being a fixed rotational axis relative to the stator cavity, the rotor having a plurality of radial vanes slots and the rotor and stator being in relative rotation; a plurality of vanes, each of the plurality of vanes sliding with at least one of a radial and axial component of vane motion within a corresponding radial vane slot of the rotor, and each of the plurality of vanes having side walls, a tip portion, and a base portion, the base portion having one or more tabs extending from at least one axial end of the vane; a first end plate adjacent a first axial side of the rotor; and a second end plate adjacent a second axial side of the rotor such that the rotor is located between the first and second end plates. The rotor shaft extends through at least one of the first end plate and second end plate. An outer circumferential surface of the rotor comprises an annular sealing lip extending axially toward respective of the first end plate and the second end plate. The plurality of vanes, the stator cavity, and the rotor define a plurality of chamber cells. The vane tip portion and the contour of the stator cavity are spaced apart by a radial clearance. The stator assembly, rotor, first end plate and second end plate together define a first combined core structure. And the first combined core structure is substantially comprised of an invar-class alloy.

The one or more tabs may be located at a radially bottom position on the base portion of the vane, or they may be located at a radially top position on the base portion of the vane, or they may be located between a radially top position and a radially bottom position on the base portion of the vane.

The one or more tabs may be formed to be retracted in the side walls of respective vanes, flush with the side walls of respective vanes, protruding from the side walls of respective vanes, or partially-recessed in the side walls of respective vanes.

The rotary machine may further comprise a plurality of vane connectors. In this case, pairs of radially-opposed vanes are connected by one or more of the vane connectors that are attached to the base portions of the pair of radially-opposed vanes. The vanes are preferably wider than the vane connectors.

BRIEF DESCRIPTION OF THE DRAWINGS

The foregoing and other objects, aspects, and advantages will be described with reference to the drawings, certain dimensions of which have been exaggerated and distorted to better illustrate the features of the invention, and wherein like reference numerals designate like and corresponding parts of the various drawings, and in which.

DETAILED DESCRIPTION OF THE INVENTION

Figure 1:
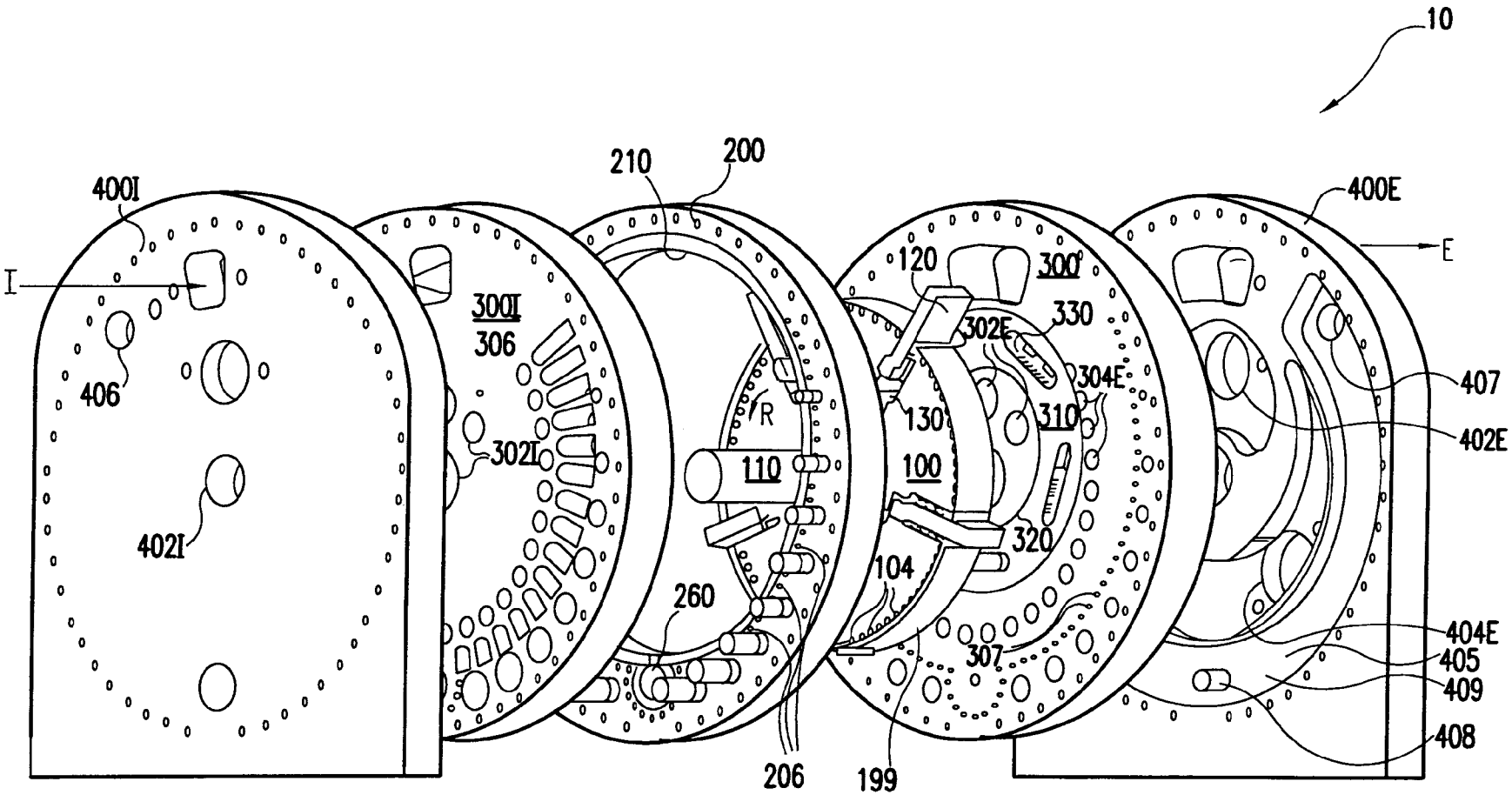
FIG. 1 is an exploded perspective view of a rotary-vane pumping machine in accordance with a preferred embodiment of the present invention.

Reference will now be made in detail to embodiments of a rotary pumping machine incorporating Invar-class alloys in association with other metal and/or ceramic materials in a low internal stress, non-contact sealing design, examples of which are illustrated in the accompanying drawings.

In general, the invention is directed to a pumping machine designed for non-contact sealing to eliminate the need for lubrication in the chamber or vane cells. Although the following description is directed to an internal combustion engine and reducing pollution emissions, one of ordinary skill in the art would understand that the advantages and features of the invention could readily be applied to any rotary vane pumping machine, including rotary vane or sliding vane pumps, compressors, engines, vacuum-pumps, and blowers.

Achieving the non-contact sealing design of the present invention required a confluence of several major parameters, each of which provides mutual and synergistic benefits to the other parameters. More specifically, once the optimum non-contact sealing clearances were determined, the right material for the machine's components had to be selected based on the thermal expansion characteristics of the material. Then, the geometry, operating loads, and component temperatures of the machine had to be conducive to allow the use of the low thermal expansion material. Finally, the low thermal expansion material had to provide a suitable hard rolling surface for roller bearings, to maintain non-contact sealing proximity, without significantly altering the low thermal expansion proper-ties of the material.

As described herein, the non-contact vane engine geometry of the invention employs and successfully exploits Invar-class low-expansion alloys, such that the vane engine geometry and alloys provide mutual and synergistic benefits. The extremely close clearances for the non-contact sealing are achieved by using Invar-class alloys having a very low coefficient of thermal expansion. Since this unique non-contact engine design has low internal stresses, the engine designer is not precluded from employing and exploiting the benefits of the Invar-class alloys, while avoiding the drawbacks. As a result, the low internal stress design of the engine permits the Invar-class alloys to be used and kept rigid, while reducing or eliminating the disadvantages associated with weakness under high material stress conditions. At the same time, the non-contact sealing features of the engine are achieved by exploiting the advantageous low thermal expansion properties of the Invar-class alloys, and by careful placement of roller bearings to maintain precise clearances. Finally, hard bearing inserts are employed along the surface of the engine components comprised of Invar-class alloys, which provides a suitable rolling surface for roller bearings to roll on, but where the inserts do not significantly alter the low thermal expansion properties of the Invar-class alloys.

As used herein, the term "roller" bearing or "rolling" bearing means any style of rolling, anti-friction bearing design, including for example, spherical bearings, cylindrical bearings, or any other suitably shaped rolling bearing know to those of ordinary skill in the art.

Note that Invar-class alloys comprise Super Invar, Invar 36 and other nickel-iron alloy variations. For ease of reference, this class of alloys will be referred to generally as Invar, unless a specific type of Invar-class alloy is preferred for a particular application.

U.S. Pat. No. 5,524,586 (the '586 patent); U.S. Pat, No. 5,524,587 (the '587 patent); U.S. Pat. No. 5,836,282 (the '282 patent); U.S. Pat. No. 6,036,462 (the '462 patent); U.S. Pat. No. 6,120,271 (the '271 patent); and U.S. Pat. No. 6,120,273 (the '273 patent). For ease of discussion, certain portions of the patents will be reiterated below where appropriate.

An exemplary embodiment of the rotary engine assembly incorporating a rotary-linear vane guidance mechanism is shown in FIG. 1 and is designated generally as reference numeral 10.

The engine assembly 10 contains a rotor 100, with the rotor 100 and rotor shaft 110 rotating about a rotor shaft axis in a counterclockwise direction as shown by arrow R in FIG. 1. It can be appreciated that when implemented, the engine assembly 10 could be adapted to allow the rotor 100 to rotate in a clockwise direction if desired. The rotor 100 has a rotational axis, at the axis of the rotor shaft 110, that is fixed relative to a stator cavity 210 contained in a stator assembly 200.

Figure 10B:
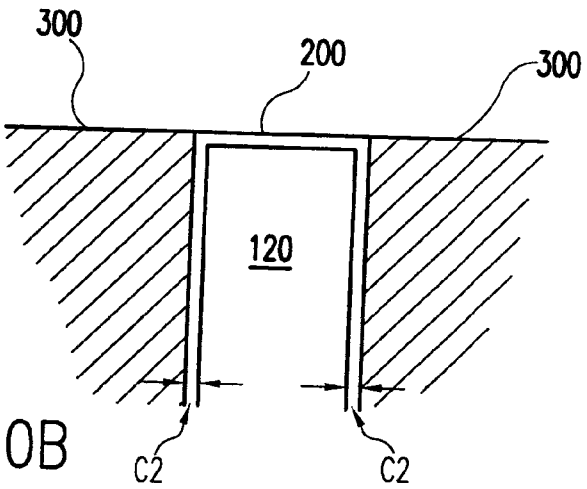
FIGS. 10A, 10B, 10C and 10D are simplified diagrams schematically illustrating the sealing clearance locations of a preferred embodiment of the present invention.
Figure 10D:
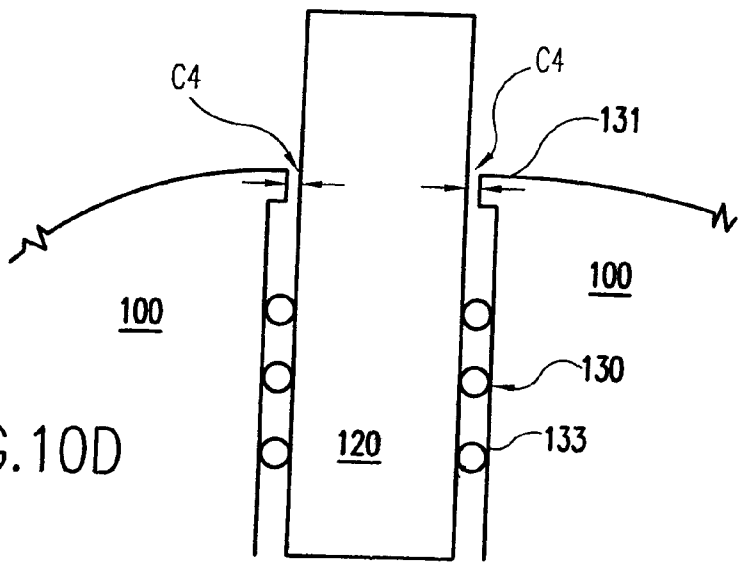

The rotor 100 houses a plurality of vanes 120 in vane slots 130, wherein each pair of adjacent vanes 120 defines a vane cell 140 (see FIG. 2), with the stator contour forming an approximately circular shape. The azimuthal faces of the vane 120 confront and slide relative to the walls of the vane slot 130. Rollers 133 are interposed between the azimuthal faces of the vane 120 and the walls of the vane slot 130 to reduce friction there between. As shown more clearly in FIG. 10D, the rotor 100 contains vane slot seals 131 extending toward the azimuthal faces of the vane 120 to seal the vane slot 130 from the vane cells 140.

Figure 4:
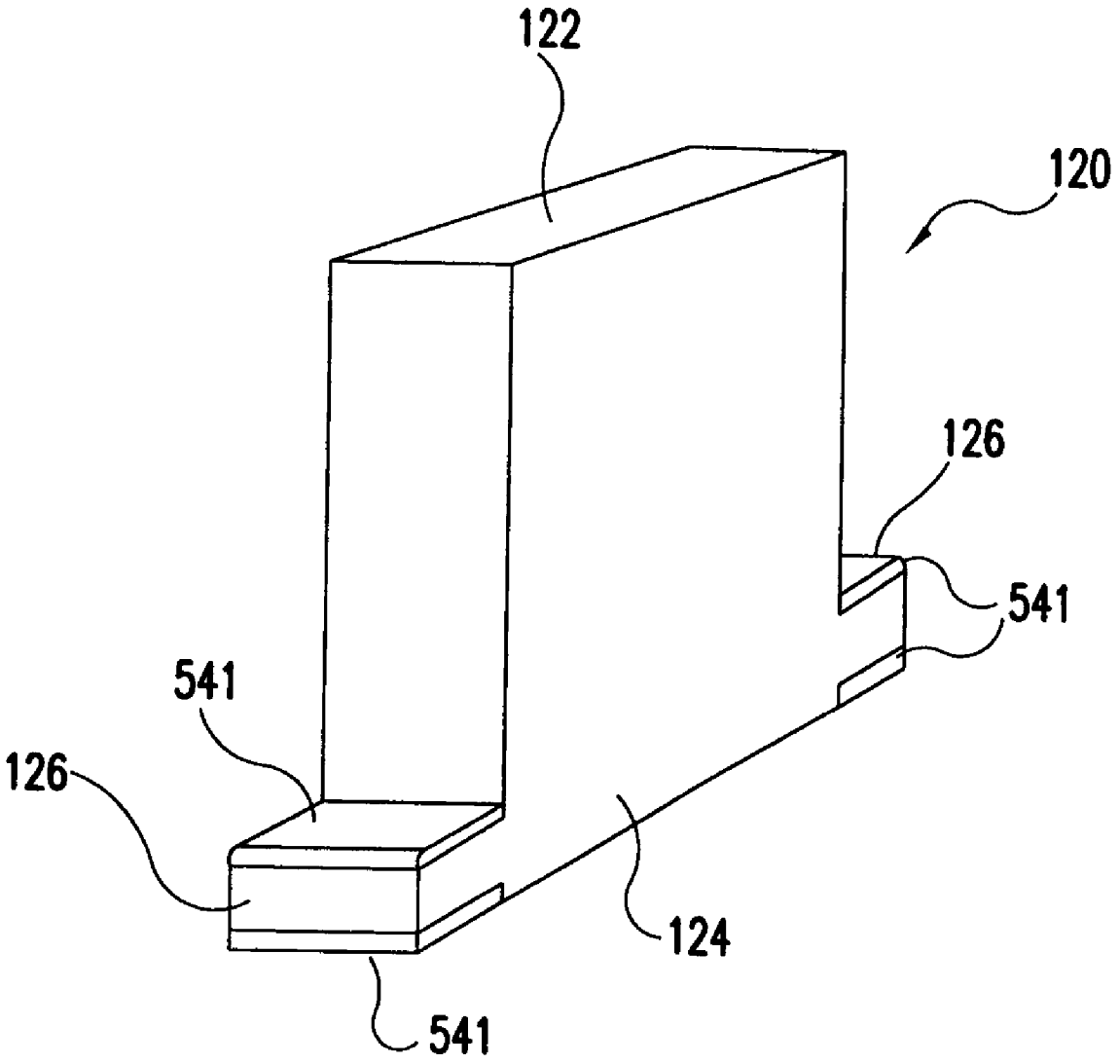
FIG. 4 is a perspective view of a vane employed in a preferred embodiment of the present invention.

Each of the vanes 120 has a tip portion 122 and a base portion 124, with a protruding tab 126 extending from either or both axial ends near the base portion 124 as shown in FIG. 4. While the tip portion 122 of the vane in FIG. 4 is rectangular, the invention is not limited to such a design, it being understood that the vane tip portion 122 may take on many shapes within the scope of the invention. The tip portion 122 may contain one or more sealing tips. As an example, a triangular shaped vane tip would provide a single sealing, tip at the apex of the tip portion, whereas the rectangular tip portion 122 in FIG. 4 would provide two sealing tips. The multiple sealing tips of a vane need not all be in near-contact with the stator contour at the same time, and the sealing tip or tips need not be symmetrical with respect to the vane center lines. Also, the chamber contour may not have a planar cross section with reference to an axial direction. In other words, the chamber contour may be curved, either convex or concave, as viewed along the axial cross section of the stator assembly.

Figure 2:
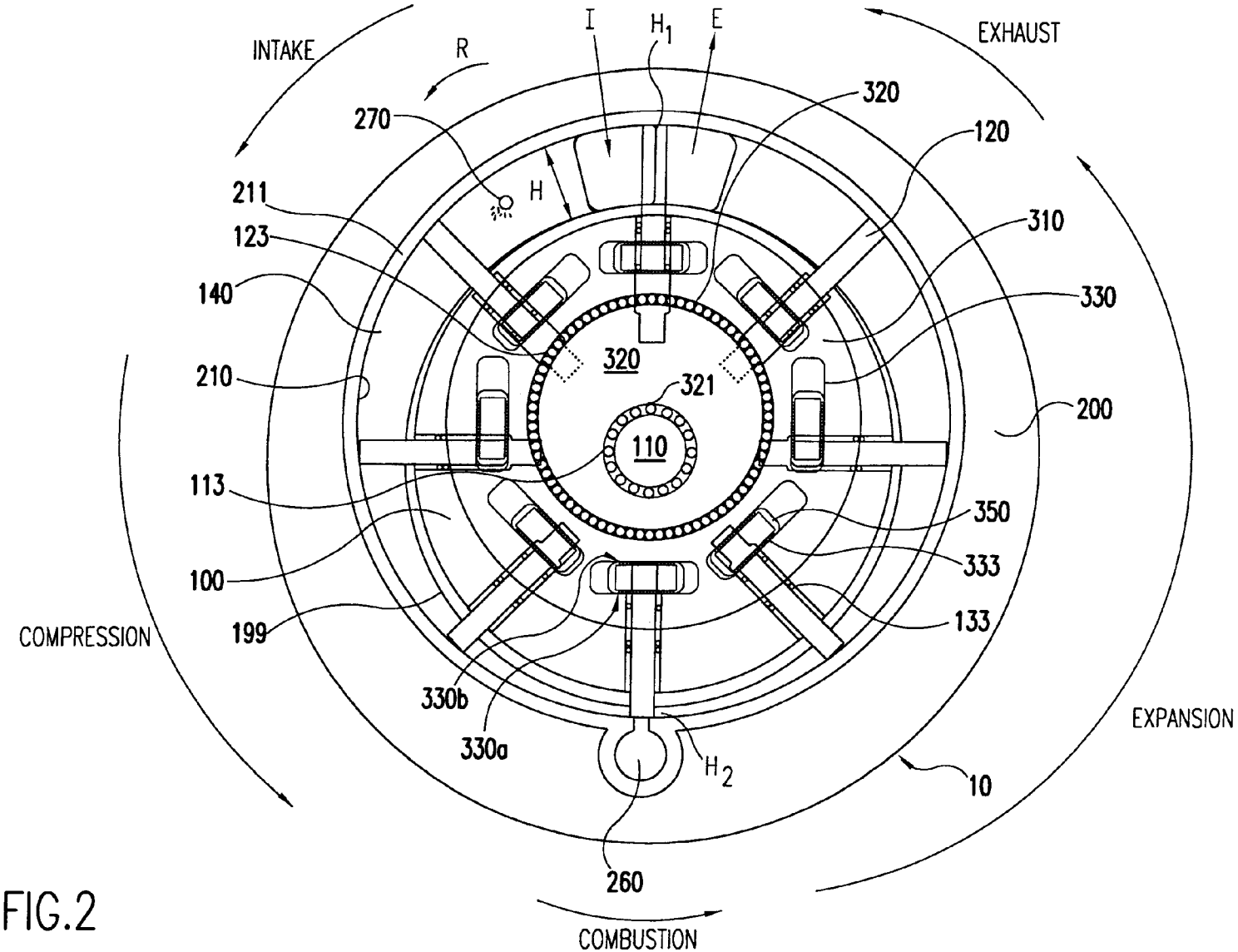
FIG. 2 is a side sectional view of a rotary-vane pumping machine in accordance with a preferred embodiment of the present invention.

As shown in FIGS. 1 and 2, an end plate 300 is disposed at each axial end of the stator assembly 200. The end plate 300 houses a linear translation ring 310, which spins freely around a fixed hub 320. The central axis 321 of the fixed hub 320 is eccentric to the axis of rotor shaft 110 as best seen in FIG. 2. The linear translation ring 310 may spin around its hub 320 utilizing any type of bearing, at the hub-ring interface including for example, a journal bearing of any suitable type and an anti-friction rolling bearing of any suitable type. In this embodiment, the linear translation ring 310 contains a plurality of linear channels 330. The vanes 120 move linearly with the linear channels 330 as the linear translation ring 310 rotates around the fixed hub 320.

In operation, each of the pair of protruding tabs 126, extending from each of the plurality of vanes 120, communicates with a respective linear channel 330 in the translation ring 310. That is, one protruding tab 126 communicates with a linear channel 330 in the linear translation ring 310 located at one axial end of the engine assembly, and the other protruding tab 126 communicates with a linear channel 330 in the linear translation ring 310 located at the other axial end of the engine assembly.

Though the machine 10 could operate successfully with the tabs 126 on only one side of the vanes 120 and communicating with only one linear translation ring 310, the best performance is obtained by the balanced, two-ended arrangement described above, namely, a linear translation ring 310 located at each axial end of the machine 10 and protruding tabs 126 communicating with each.

In operation, the rotor 100 rotation causes rotation of the vanes 120 and a corresponding rotation of each linear translation ring 310. The protruding vane tabs 126 within the linear channels 330 of the linear translation rings 310 automatically set the linear translation rings 310 in rotation at a fixed angular velocity identical to the angular velocity of the rotor 100. Therefore, the linear translation ring 310 does not undergo any significant angular acceleration at a given rotor rpm.

Also, the rotation of the rotor 100 in conjunction with the linear translation rings 310 automatically sets the radial position of the vanes at any rotor angle, producing a single contoured path as traced by the vane tips 122 resulting in a uniquely shaped stator cavity 210 that mimics and seals the path traced by the vane tips. Depending on the configuration of the vanes 120 and the stator cavity 210, each linear channel 330 in the linear translation ring 310 may have an outer radial wall 330*a* and an inner radial wall 330*b* that interface with the tabs, or the linear channel 330 can have a single inner wall or surface that serves as the outer surface of the linear translation ring 310 itself, described later.

Referring again to FIG. 1, note that no gearing is needed to maintain the proper angular position of the linear translation rings 310 because this function is automatically performed by the geometrical combination of the tabs 126 within the linear channels 330 of the linear translation rings 310, the radial motion of the vanes 120 within their vane slots 130, the rotor 100 about its shaft 110 axis, and the translation ring hub 320 about its offset axis 321.

With this unique geometry of the present invention, the linear channels 330 are not exposed to the engine chamber, i.e., the cascading vane cells 140 of the rotary vane engine, and can thus be lubricated with, for example, oil, oil mist, dry film, grease, fuel, fuel vapor or mist, or a combination thereof, without encountering major lubricant contamination problems in the vane cells 140. More specifically, as best shown in FIG. 2, the outer surface 199 of the rotor 100 forms the inner radial boundary of the vane cell 140. The outer surface 199 thus acts as a barrier, preventing any major contaminants from entering the vane cell 140. In other words, the outer surface 199 of the rotor 100 isolates the following moving parts from the vane cells 140: (i) the linear channels 330 and its rollers 333, if any; (ii) vane slots 130 and their rollers 133, if any; (iii) the hub 320 and its rollers 123, if any; (iv) the rotor axis 110 and its rollers 113, if any; and (v) rotor thrust bearings (described later), if any.

Figure 3:
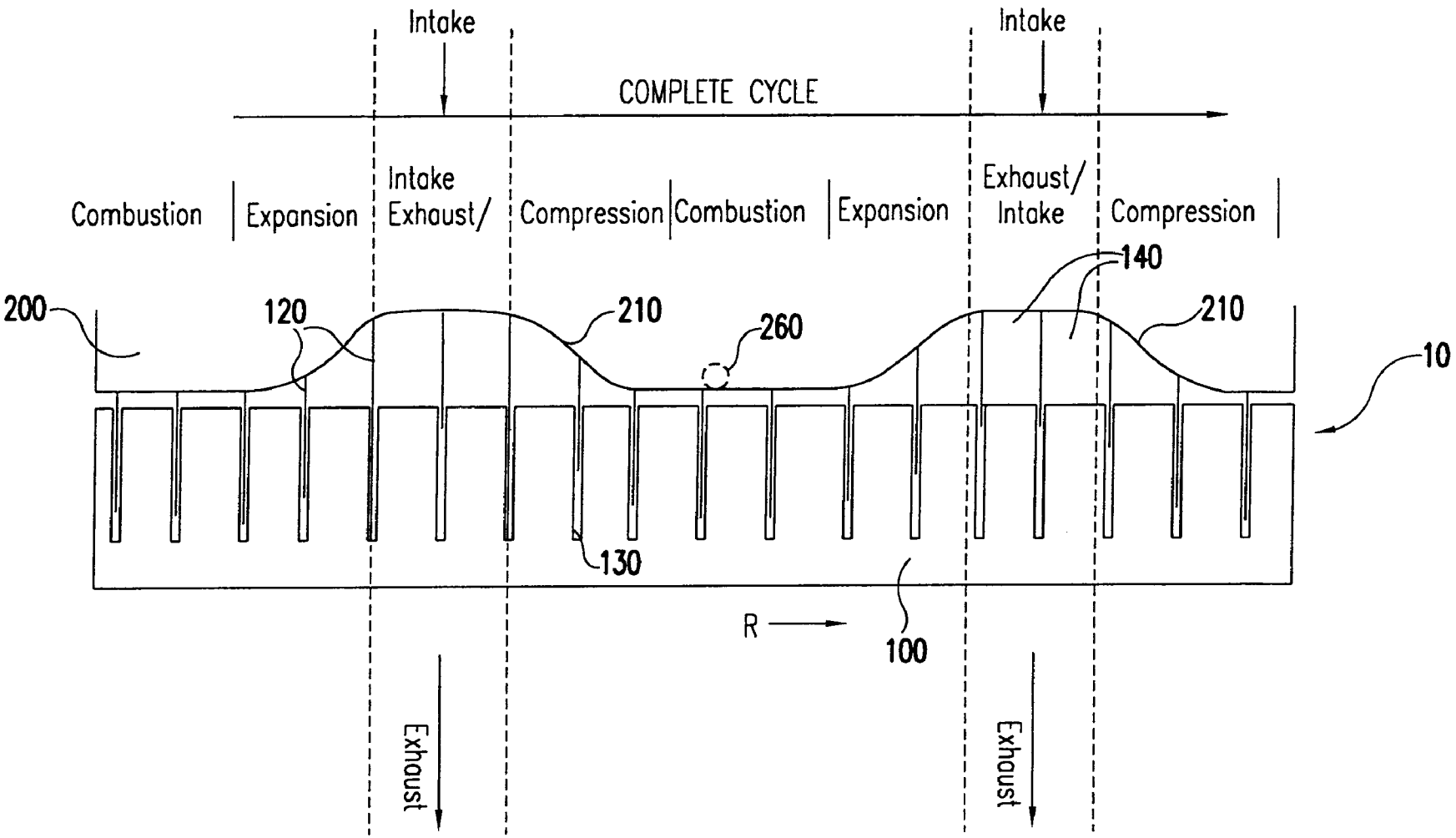
FIG. 3 is a side view of an axial embodiment of the pumping machine.

FIG. 3 is a simplified diagram illustrating how the embodiment would appear if the rotor 100 were unrolled or straightened. It is thus representative of an alternate embodiment wherein the vanes slide with an axial component of vane motion, or with a vector that includes both axial and radial components. The apparatus of FIG. 3 contains the like components as the apparatus of FIG. 1, and the same reference numerals are used to designate the same or like parts.

The engine assembly 10 contains rotor 100, with the rotor 100 rotating in a direction as shown by arrow R in FIG. 3. It can be appreciated that when implemented, the engine assembly 10 could be adapted to allow the rotor 100 to rotate in the opposite direction if desired. The rotor's rotation is fixed relative to a stator cavity 210 contained in a stator assembly 200. The rotor 100 houses a plurality of vanes 120 in vane slots 130, wherein each pair of adjacent vanes 120 defines a vane cell 140, with the surface of the stator cavity 200 confronting the rotor 100 defining the chamber contoured surface 210.

Figure 7:
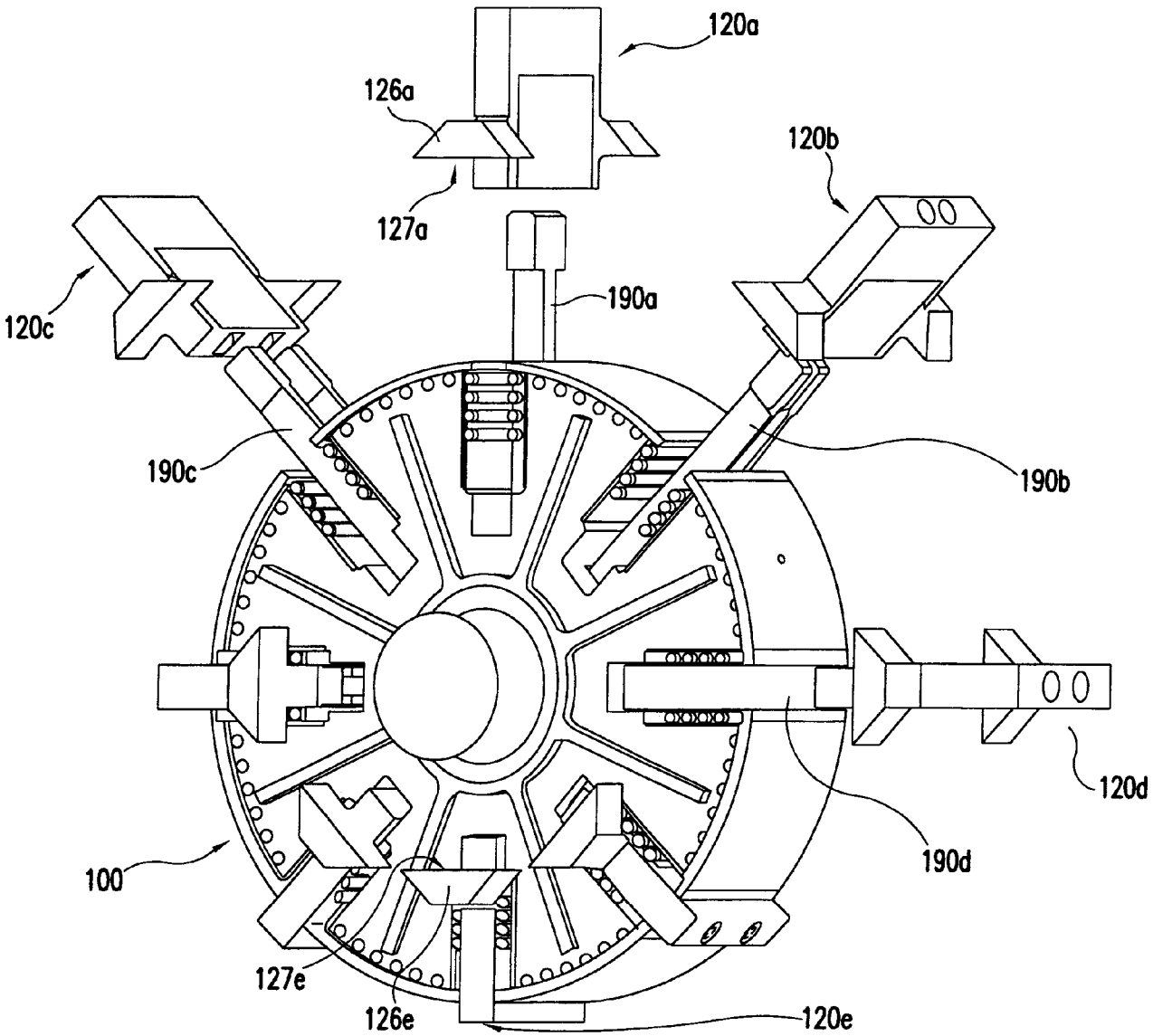
FIG. 7 is a partially exploded perspective view of the rotor, vanes, and tie bars of an alternate embodiment of the present invention.
Figure 8:
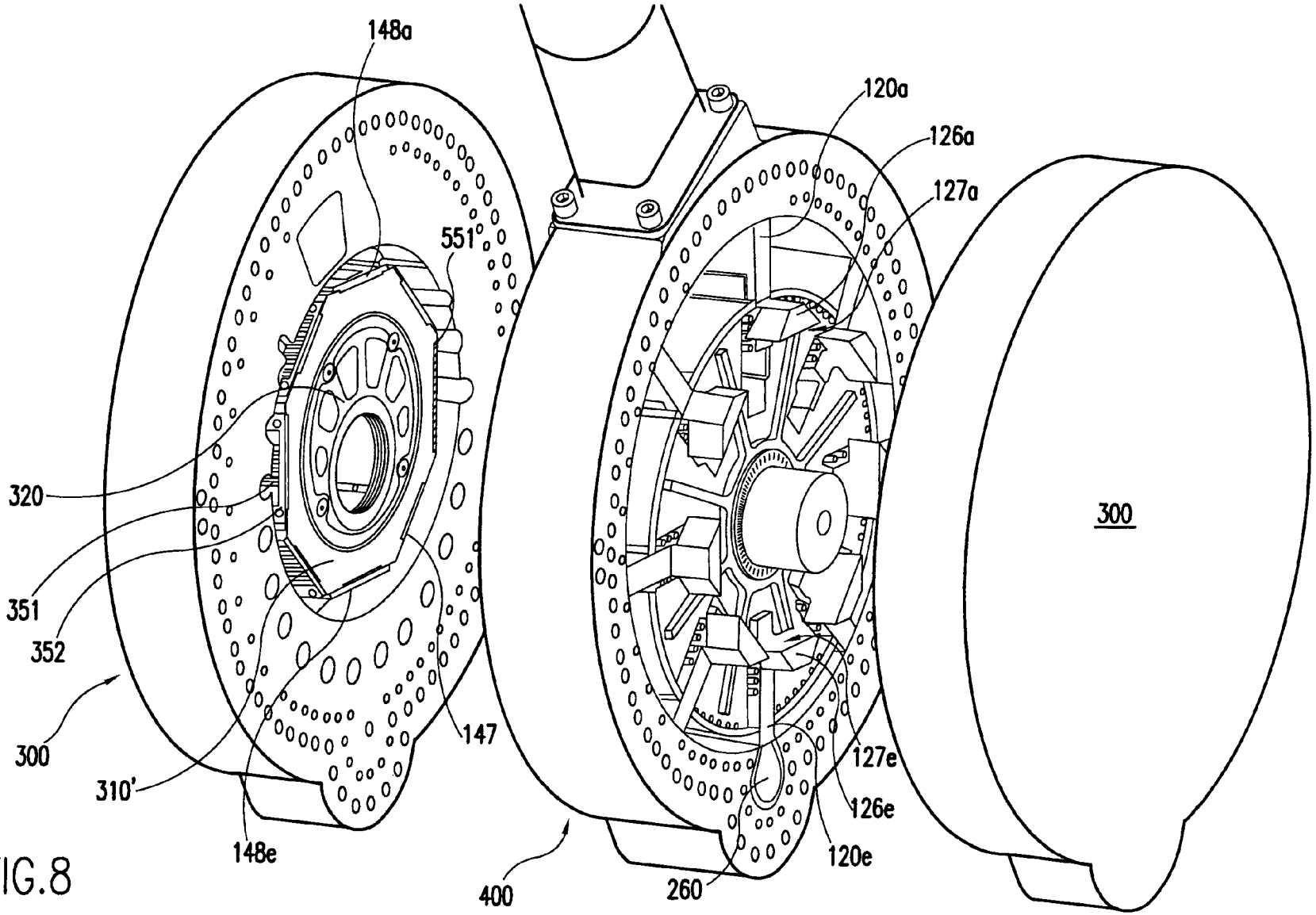
FIG. 8 is a perspective view of the rotor, a stator ring assembly, and an end plate with a linear translation ring according to the embodiment of the present invention using the rotor, vanes and tie bars of FIG. 7.

In an alternate preferred embodiment, FIG. 7 and FIG. 8 show a mechanism for connecting the vanes 120 so as to eliminate the need for the outer radial surface 330*a* of the linear channels 330 described with reference to FIG. 1 and FIG. 2. More specifically, each pair of diametrically opposed vanes 120 is connected by a rigid tie bar 190*a*, 190*b*, 190*c*, or 190*d* that does not expand or contract appreciably during operation. As shown in FIG. 8, the modified linear translation ring 310' eliminates the outer radial surface 330*a* of the linear channels 330, and instead comprises a single radial surface 147 having a plurality of connected linear segments (e.g., 148*a*, 148*c*) or facets, which linear segments generally correspond to the inner radial surface 330*b* of the linear channels 330 in FIG. 1 and FIG. 2. Accordingly, the protruding tabs 126 of the vanes 120 need only slide along a corresponding linear segment 148 of the outer radial surface 147, which still provides sufficient linear and radial guidance to the vanes 120. In operation, therefore, an extending vane 120, e.g., 120*a*, is prevented from contacting the stator cavity 210 with too much force by the interaction of a radially inward surface 127*e* of an opposite tab 126*e* contacting the linear segment 148*e*.

In general, the modified linear translation ring 310' takes the form of a polygon with a pair of diametrically-opposed linear segments for every connected vane pair. The sliding contact between the tabs 126 and the linear segments 148 can be accomplished with a sliding joint or roller bearings 351. The bearings 351 may be disposed in a housing or cage 352 that is attached to the linear segment 148 or to the radially inner surface 127 of the tab 126. Further details regarding the assembly and connection of such tied vanes is disclosed in the '273 patent.

Figure 11:
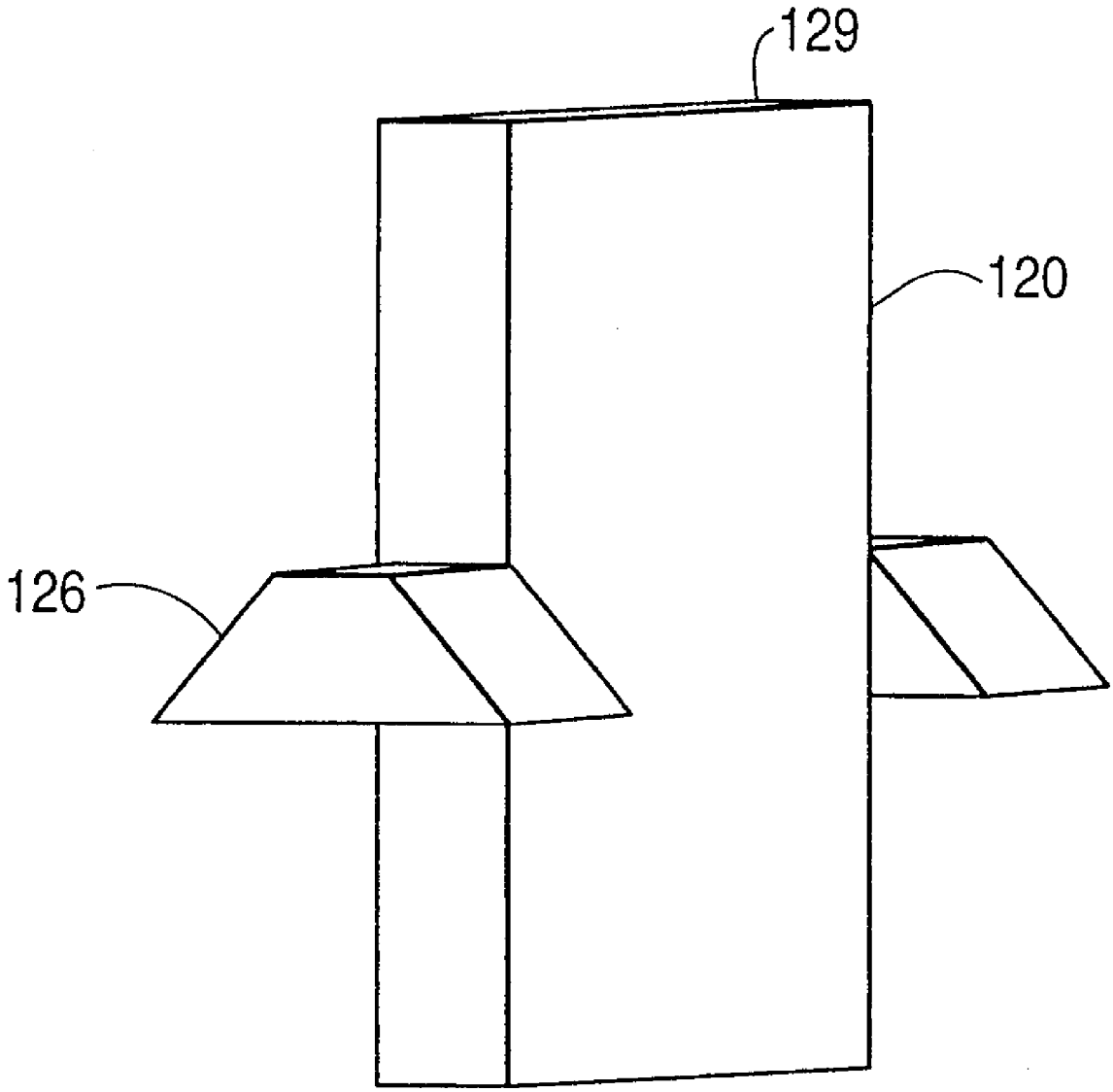
FIG. 11 is a perspective view of a vane used in the alternate preferred embodiment of FIGS. 7 and 8.

FIG. 11 is a perspective view of a vane 120 used in the alternate preferred embodiment of FIGS. 7 and 8. As shown in FIG. 11, the vane 120 includes one or more protruding tabs 126. (Although two protruding tabs 126 are disclosed in FIG. 11, one may be omitted without departing from the scope of this invention.) These protruding tabs can be placed anywhere along the radial height of the vane 126, except at the very tip 129 (i.e., at the outward radial end). All that is necessary is that there be some part of the tip 129 of the vane 120 extend radially outward from the protruding tab 126.

Each protruding tab 126 has a radially inner surface 127 as described above. This surface 127 operates in the same manner regardless of where the protruding tab is placed radially on the vane 120.

Figure 12A:
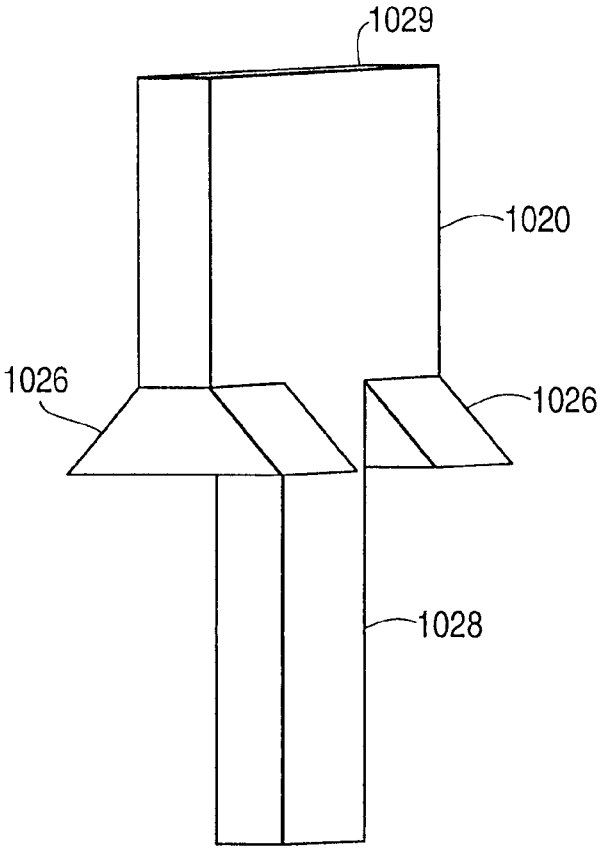
FIGS. 12A and 12B are perspective views of vanes used in additional preferred embodiments of the present invention.
Figure 12B:
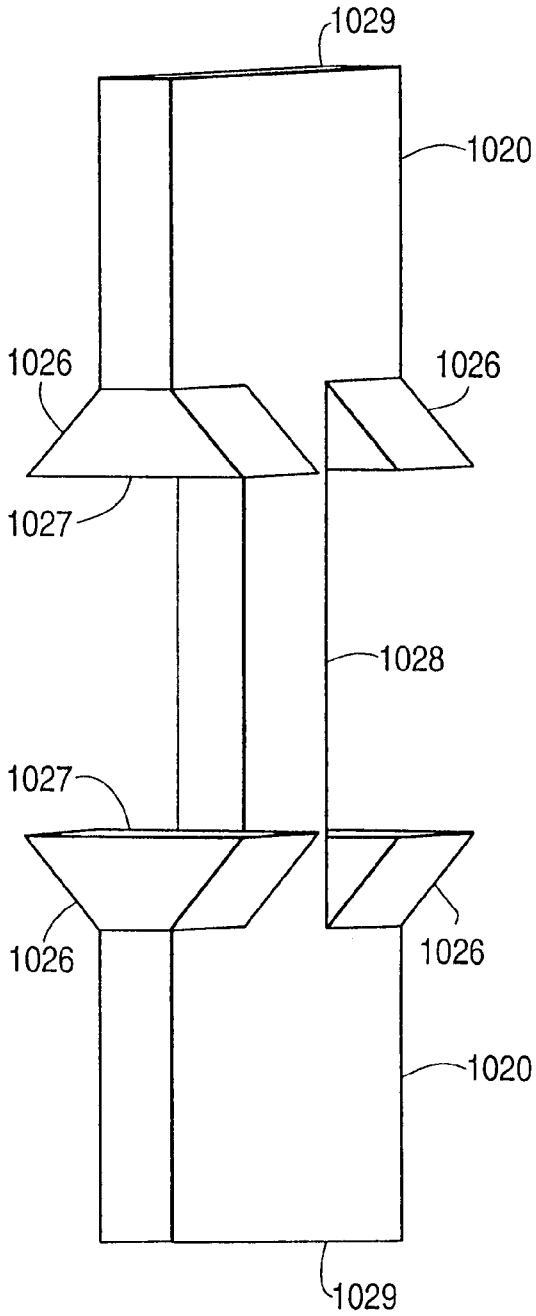

FIGS. 12A and 12B are perspective views of vanes used in additional preferred embodiments of the present invention. FIG. 12A shows a single vane 1020, and FIG. 12B shows two vanes 1020 connected together and with their tops 1029 both facing radially outward.

FIG. 12A shows a vane 1020 having flush tabs 1026 instead of the protruding tabs 126 of FIG. 11. Although these flush tabs 1026 flare out in front of and behind the face of the vane 1020, they remain flush with the side of the vane 1020. Preferably the flush tabs 1026 are separate pieces, connected to the vanes 1020. However, the flush tabs 1026 could also be formed as an integral part of the vane 1020.

Each flush tab 1026 has a radially inner surface 1027 similar to the radially inner surface 127 described above with reference to FIGS. 7, 8, and 11. This surfaces 1027 operates in the same manner as the radially inner surfaces 127, i.e., being exposed to the linear segment 148 of the outer radial surface 147 of the modified linear translation ring 310'. However, since the flush tabs 1026 are supported on their top and side by the vane 1020, they are stronger than the protruding tabs 126, which are only supported by the vane 120 on their side.

Because the tabs 1026 are flush with the side walls of the vane, the modified linear translation ring 310' must extend into a recess within the rotor. This can make the device more compact.

A narrow vane connector 1028 is connected to the base of the vane 1020. This narrow vane connector 1028 supports the vane 1020, without interfering with the radially inner surfaces 1027 of the flush tabs 1026. In this preferred embodiment, each pair of vanes is connected to one or more vane connectors 1028. These vane connectors 1028 are arranged such that all of the vanes 1020 are connected with their corresponding vane 1020, but none of the vane connectors 1028 interfere with each other as they pass through the center of the rotor 100.

Preferably the vanes 1020 and the vane connectors 1028 are formed of one integral piece. However, in alternate embodiments, the two could be formed as separate pieces connected together.

FIG. 12B shows two vanes 1020 connected together by a single narrow vane connector 1028. The narrow vane connector 1028 preferably passes through or near the axis of rotation of the rotor 100, and serves to support both of the vanes 1020 as they rotate and move radially. In this embodiment, the narrow vane connector 1028 passes through the rotor and so should be no wider than the rotor itself.

Figure 13:
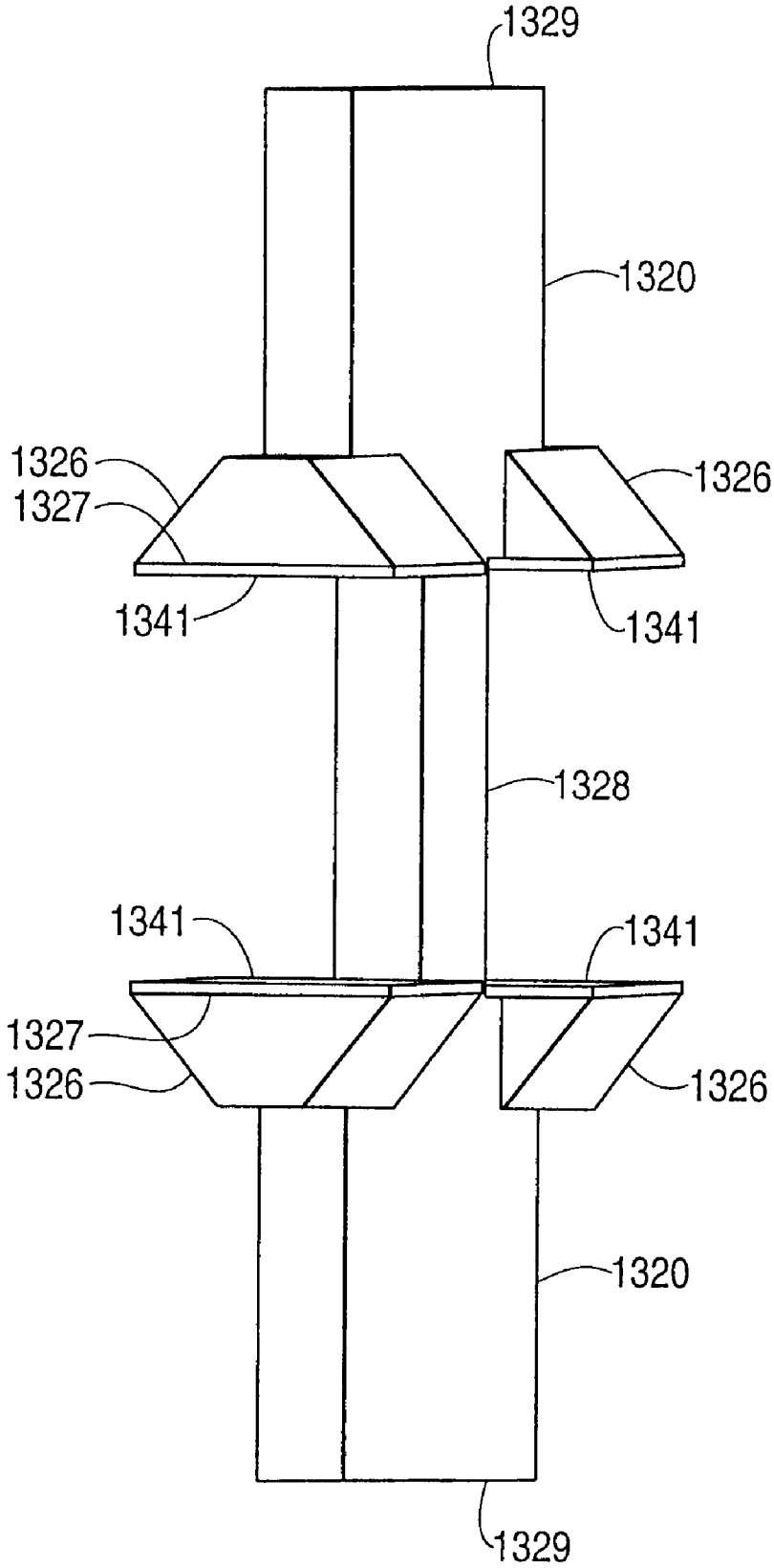
FIG. 13 is a perspective view of a pair of vanes used in a further preferred embodiment of the present invention.

FIG. 13 shows two vanes 1320 connected together and with their tops 1329 both facing radially outward. The vanes 1320 having partially-recessed tabs 1326 instead of the protruding tabs 126 of FIG. 11 or the flush tabs of FIGS. 12A and 12B. The partially-recessed tabs 1326 are formed partially under the vanes 1320 and partially protruding out from the vanes 1320. Preferably the partially-recessed tabs 1326 are separate pieces, connected to the vanes 1320. However, the partially-recessed tabs 1326 could also be formed as an integral part of the vane 1320.

Each flush tab 1026 has a radially inner surface 1027 similar to the radially inner surface 127 described above with reference to FIGS. 7, 8, and 11. This surfaces 1027 operate in the same manner as the radially inner surfaces 127, i.e., being exposed to the linear segment 148 of the outer radial surface 147 of the modified linear translation ring 310'. In this embodiment, hard bearing inserts 1341 are formed on the radially inner sides 1327 of the partially-recessed tabs 1326. These hard bearing inserts may be used in any of the embodiments to protect the inner radial tab surfaces or to improve the contact properties of the inner radial tab surfaces.

Since the partially-recessed tabs 1326 are supported on their side and partially on their top by the vane 1320, they are stronger than the protruding tabs 126, which are only supported by the vane 120 on their side.

A narrow vane connector 1328 is connected to the base of the vane 1320. This narrow vane connector 1328 supports the vane 1320, without interfering with the radially inner surfaces 1327 of the partially-recessed tabs 1326 . In this preferred embodiment, each pair of vanes is connected to one or more vane connectors 1328. These vane connectors 1328 are arranged such that all of the vanes 1320 are connected with their corresponding vane 1320, but none of the vane connectors 1328 interfere with each other as they pass through the center of the rotor 100.

In this embodiment the vane connector 1328 is more narrow than the distance between the partially-recessed tabs 1326. In alternate embodiments the vane connector may be wider or narrower, provided that it is strong enough to support the vanes 1320, and is no wider than the rotor.

As above, because the tabs 1326 are partially-recessed in the side walls of the vane, the modified linear translation ring 310' must extend into a recess within the rotor. This can make the device more compact.

In alternate embodiments, vane tabs can be retracted into the vane such that the side wall of the tab is receded from the side wall of the vane.

As shown in FIG. 1, FIG. 2, and FIG. 8, a combustion residence chamber (i.e., a flame pocket) 260 may be provided in the stator assembly 200 for the internal combustion engine application. The flame pocket 260 is a cavity or series of cavities within the stator assembly 200, radially and/or axially disposed from a vane cell 140, which communicates with the air or fuel-air charge at about peak compression in the engine assembly. The flame pocket 260 may physically create an extended region in communication with the vane cell 140 during peak compression.

The particular parameters of such an extended region (e.g., the compression ratio, vane rotor angle, number of vanes, flame pocket position and volume) may vary considerably within the practice of this invention. What is important in an internal combustion engine application is that there is a sufficient duration to the combustion region so that there is adequate time to permit near-complete combustion of the fuel. The flame pocket 260, by retaining a hot combusted charge in its volume, permits very lean mixtures to be combusted. This feature permits very low pollution levels to be achieved, as more fully described in the '586 patent and the '282 patent.

When the present invention is used with internal combustion engines, one or more fuel injecting or induction devices 270 (FIG. 2) may be used and may be placed on one or both axial ends of the chamber and/or on the outer or inner circumference of the chamber. Each injector 270 may be placed at any position and angle chosen to facilitate equal fuel distribution within the cell or vortices while preventing fuel from escaping into the exhaust stream. The injector(s) 270 may be placed in a variety of locations with reference to the vane cells and intake port, as more fully described in the '586 patent and the '282 patent.

As shown in FIG. 1, a pair of cooling plates 400 encase the machine 10, provide ports for the cooling system, and serve as an attachment point for various devices used to operate the machine or engine 10. Although shown and described as separate structures in FIG. 1 for ease of illustration, one of ordinary skill in the art would understand that the separate features and functions of the cooling plates 400 and the end plates 300 could be combined into a single structure disposed at each axial end of the machine.

The illustrated internal combustion engine embodiment employs a two vane-stroke cycle to maximize the power-to-weight and power-to-size ratios of the engine. In other words, each vane retracts (first stroke) and extends (second stroke) once for each complete combustion cycle. By comparison, in a four vane-stroke cycle, each vane would retract and extend twice for each complete combustion cycle. The intake of the fresh air I and the scavenging of the exhaust E occur at the regions as shown in FIG. 1 and FIG. 2.

The cooling system for such a rotary vane pumping machine was described in U.S. Pat. No. 6,086,346 (the '346 patent), which is hereby incorporated by reference in its entirety. Basically, the '346 patent describes a cooling system that can cool either the rotor 100 and associated moving parts, or the stator assembly 200, or both, depending on the operation of the rotary vane pumping machine. This is because in the unique geometry of the present invention, the rotor 100 and stator assembly 200 provide unique and important inward and outward radial boundaries to the vane cells 140 where compression or combustion, or both, may generate extra heat.

Generally, for rotor cooling, a cooling gas is supplied at a rotor cooling gas supply port 402 in a cooling plate 400, passes axially through rotor cooling gas channels 302 in an end plate 300, enters a rotor face chamber 101 at an entry radius near the rotor shaft 110 (see FIG. 5), flows in a radially outward direction toward a plurality of rotor gas channels 104 while absorbing heat from the rotor 100, and exits axially through a rotor heated gas exit port 404 in another cooling plate 400 via a plurality of rotor heated gas channels 304 in another end plate 300.

Because the unique geometry of the invention allows the use of a gas to cool the rotor, several benefits accrue. First, rotating components of the rotor can be cooled without using complex rotating cooling seals. Second, the inertia of the gas is low enough to avoid transmitting momentum or drag between moving components. Third, since the gas is flowing over the moving parts with rolling, bearings, and since high speed rolling bearings are better lubricated with a lubricating mist than with a liquid, the lubricating mist can be carried by the rotor cooling gas. The moving, parts with rolling bearings that are reached by the cooling gas may include the rotor shaft 110, the vane slots 130, the linear translation ring 310, the linear channels 330, and the thrust bearings 170 described later (see FIG. 6.)

The axial faces of the rotor 100 are recessed to form rotor face chambers 101 (see FIG. 5) between the rotor 100 and the adjacent plate (whether a cooling plate 400 or an end plate 300) in which rotor cooling gas can circulate and efficiently absorb heat from the rotor 100. The engine geometry takes advantage of centrifugal pumping, i.e., the tendency for a spinning gas to move radially outward from an axis of rotation, by introducing the rotor cooling gas through a channel 302 at an entry radius close to the axis of rotation of the rotor, and by providing an escape path through another channel (i.e., rotor gas channels 104) positioned radially outward of the entry radius.

Figure 5:
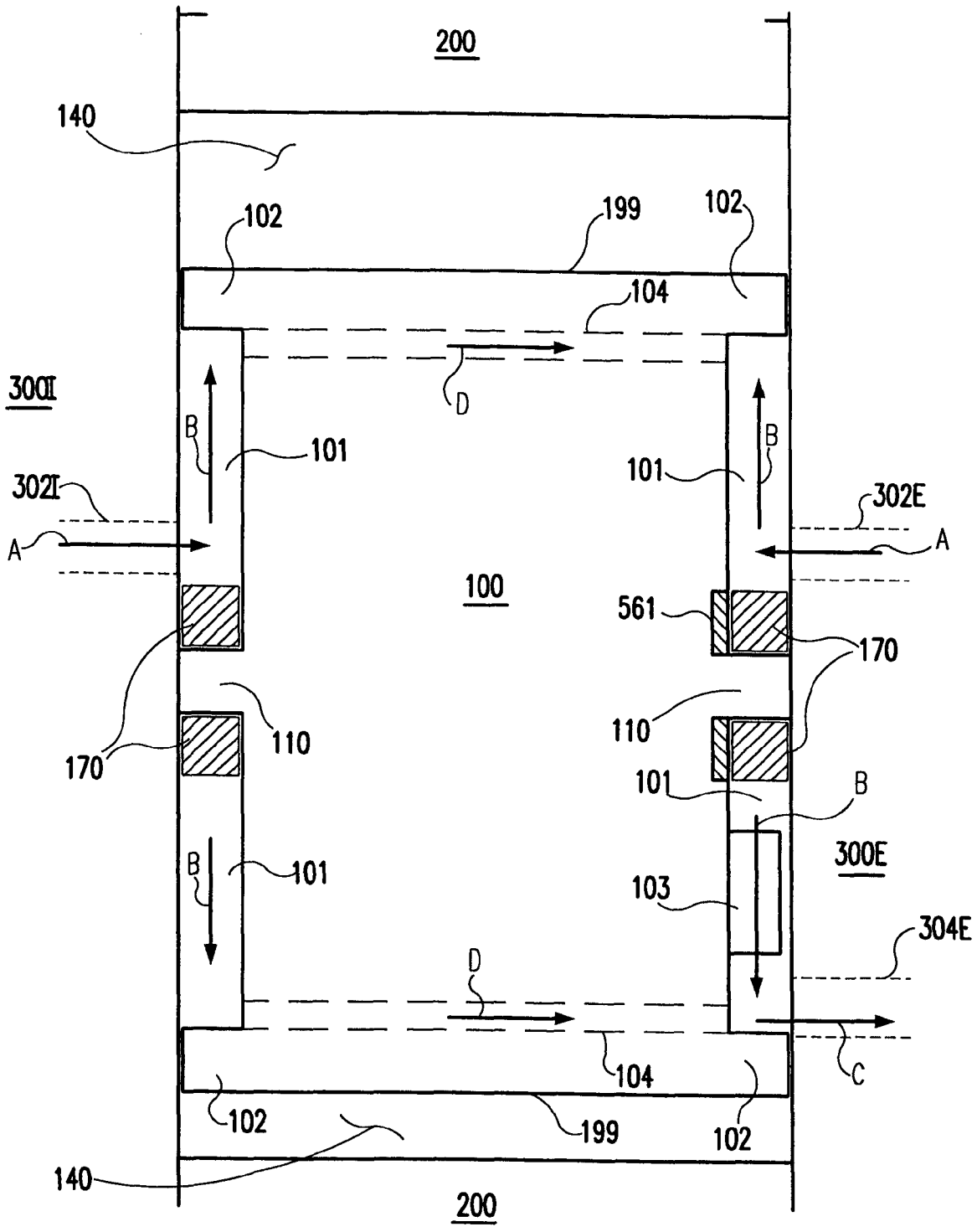
FIG. 5 is a schematic axial cross section through the rotor and the corresponding faces of both end plates according to the embodiment of FIG. 1.

The rotor 100 includes a plurality of rotor gas channels 104 positioned radially outward of the rotor cooling gas channels 302. The rotor gas channels 104 pass axially through the rotor 100 to provide primary cooling for the rotor 100 and flow communication between the opposite rotor face chambers 101. As shown in FIGS. 1 and 5, the rotor gas channels 104 are arranged along the circumference and just radially inward of the outer circumferential surface 199 of the rotor. The size, number and spacing of the rotor gas channels 104, as well as the distance between the rotor gas channels 104 and the outer circumferential surface 199, are chosen so the rotor gas channels 104 provide an effective means for cooling the rotor 100 a desired amount at the outer circumferential surface 199 where much of the rotor's heat is concentrated. By properly removing such heat, thermal stresses and sealing feature distortions can be reduced. This is especially important for achieving the tight clearances required for the non-contact sealing design of the present invention.

According to the embodiment of FIG. 5, a rotor cooling gas enters both rotor face chambers 101 near the axis of the rotor through rotor cooling gas channels 302I and 302E in respective adjacent end plates 300I and 300E, as indicated by arrows A. As a result of the centrifugal pumping phenomenon (and/or an induced pressure differential brought about by, for example, a blower), the rotating gas progresses radially outward along the rotor face as indicated by arrows B, while absorbing heat from the rotor 100. The now heated cooling gas leaves the rotor 100 through the rotor heated gas channels 304E disposed only in the exhaust end plate 300E as indicated by arrow C.

Figure 6:
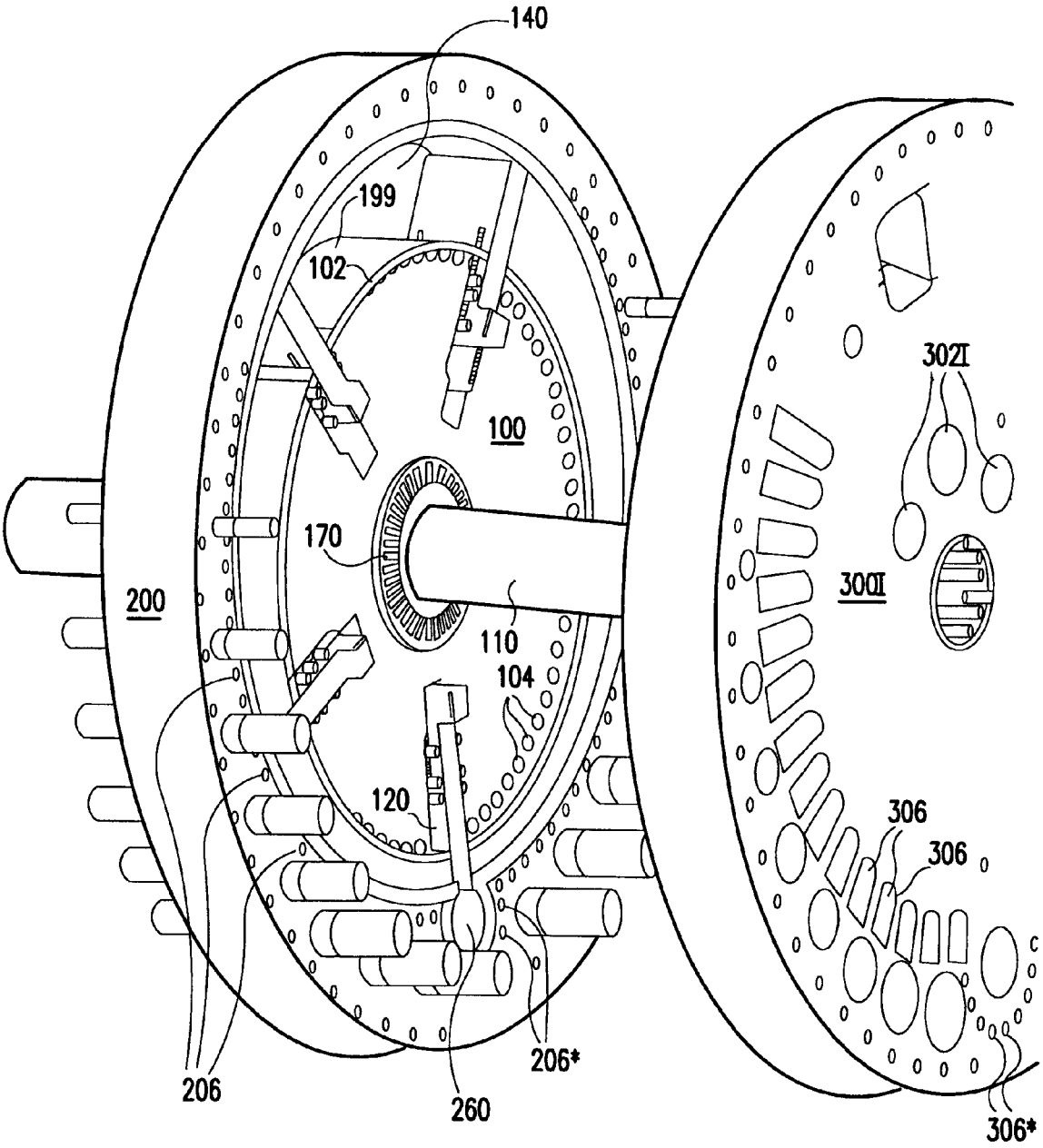
FIG. 6 is a partly exploded perspective view of the stator, the rotor, and the end plate on the intake side of the engine according to the embodiment of FIG. 5.

As shown in FIG. 5 and FIG. 6, an annular sealing lip 102 is formed along the outer circumferential surface 199 of the rotor 100 and extends axially toward each adjacent plate, here end plates 300. The sealing lips 102 are formed to substantially prevent hot compressed or combusted gases in the vane cells 140 from seeping into the rotor face chamber 101, substantially lowering efficiency, and perhaps even damaging the structures bordering the rotor face chamber 101 such as the linear translation channels 330 and vane slots 130 (see FIG. 2). Simultaneously, the sealing lips 102 substantially prevent cooling gas flowing along the rotor face chambers 101 (arrow B in FIG. 5) from seeping into the vane cells 140 of the machine.

Because of the sealing lips 102 and vane slot seals 131, lubricants (e.g., a lubricant mist) can be added to the rotor cooling gas without contaminating the fluid (e.g., a fuel-air mixture) in the vane cells 140 of the machine. Such a lubricant can lubricate the moving parts in contact with the rotor face chambers 101, such as the vane slot rollers 133 in the vane slots 130, the bearings 333 of shuttle cages 350 in the linear translation channels 330 of the linear translation ring 310, the bearings 113 around the rotor shaft 110, and the bearings 123 around the hub 320, all shown in FIG. 2, or the rollers 351 on the linear segments 148 as shown in FIG. 8. A lubricant mist is the preferred method of lubricating high speed rolling bearings. Also, rolling bearings require less lubricant than sliding or journal bearings, thus lower concentrations of mist can be used which reduces the chances for polluting the environment. This rotor cooling arrangement and unique geometry therefore simultaneously solve two problems: first, cooling the moving parts associated with the rotor; and second, lubricating those moving parts in a simple fashion without using large amounts of lubricating liquids that can pollute the environment.

To maintain the sealing lips 102 in close sealing proximity to the respective adjacent end plate 300, without excessive wear or friction on the sealing lips 102, a thrust bearing 170 is disposed between the rotor 100 and each adjacent end plate 300, close to the rotor shaft 110 and radially inward of the rotor cooling, gas channels 302 that introduce cooling gas into the rotor face chambers 101. In this position, the thrust bearings 170 provide tight control over the axial seal gap, i.e., the gap between the annular sealing lips 102 and the adjacent end plate 300. This control can be maintained even when the rotor outer circumferential surface 199 is exposed to the high temperatures of a rotary vane combustion engine (10 in FIG. 1). The bearings of the thrust bearing 170 reduce the friction at the axial load bearing contact between the thrust bearing 170 and the hub 320 of the end plate 300. In the preferred embodiment, spherical or cylindrical rolling, bearings are employed, and may be lubricated by the mist mixed in the rotor cooling gas.

The cooling of the stator assembly 200 and the end plates 300 will now be described. Referring to FIG. 1, the stator assembly 200 is cooled using a cooling fluid, which can be either a gas such as air or a liquid such as water. The stator/end plate cooling system delivers the cooling fluid from outside the rotary-vane pumping machine to the vicinity of the stator cavity boundary 210.

The stator and end plate cooling fluid (hereinafter referred to as "stator cooling fluid" for simplicity) passes axially in a single overall direction through the rotary-vane pumping machine. In the embodiment of FIG. 1, the stator cooling fluid supply port can be either the intake side fluid port 406 or the exhaust side fluid port 407, but for simplicity, we will assume the cooling fluid flows from the intake fluid port 406 to the exhaust fluid port 407. Generally, the stator cooling fluid enters at stator cooling fluid supply port 406 in cooling, plate 400I, passes through end plate cooling fluid channels 306 in end plate 3001, flows through stator fluid channels 206 in the stator assembly 200, and exits at a stator cooling fluid exit port 407 in the other cooling plate 400E, via end plate heated fluid channels 307 in the other end plate 300E. The cooling fluid thus absorbs heat in the stator 200 and end plates 300 during its axial flow through the engine.

The number, size and spacing of the stator fluid channels 206 are chosen to effectively carry away the heat transmitted into the stator assembly 200 from the vane cells 140. For example, the stator fluid channels 206 can be formed to keep the temperature of the stator assembly 200 substantially uniform, even though heat sources are not uniformly distributed around the stator cavity 210. In the embodiments of FIG. 1 and FIG. 6, the stator fluid channels 206 are arranged only along a portion of the inner radial edge of the stator assembly 200 where the greatest heat production is expected to occur. In addition, the distance from the stator fluid channel 206 to the inner radial edge of the stator assembly 200 is spaced to effectively absorb the heat transmitted to that portion of the stator assembly 200.

Using the rotor cooling gas or stator/end plate cooling fluid, or both, according to the rotor and stator assembly cooling system of the present invention, the rotating rotor and stator of a rotary vane pumping machine can be cooled without interfering with the complex moving interactions of the machine, even when the machine is a rotary vane internal combustion engine. In addition, the rotating parts can be cooled without complex rotating cooling seals, and the rolling bearings can be properly lubricated using the same rotor cooling gas.

The present invention furthermore provides a cost-effective means to permit non-contact vane tip sealing at an extremely close proximity to the stator boundary by minimizing thermal expansion of the stator and rotor without incurring noticeable thermal losses and without risking catastrophic failure should temporary contact and abrasion occur. Intermittent or sporadic contact between the vane tips and the stator boundary would not decrease the efficacy of the non-contact sealing features of the present invention.

Through experimentation directed to predicted seal losses and required gaps in the present engine design, it was determined that the engine could operate efficiently with a 'non-contact' vane tip-to-stator cavity gap, but this gap needs to be quite small, on the order of 1 mil (0.001") or less for a typical small automotive application, and preferably on the order of 0.5 mils (0.0005") or less. Note that the requisite gap is scalable with the size of the engine, which will be described in more detail later. The simple projected shapes of the engine, combined with the small number of components, enable the engine to be manufactured easily and economically, and allow the clearances to be made to a precision of 0.5 mils or smaller.

To adequately address this differential expansion problem, and referring to FIG. 1, the following materials strategy is employed. For ease of discussion and to better describe the advantages of the invention, the pumping machine is segregated into a core structure, which forms the crux of the pumping machine, and peripheral components, which are all the other machine components, such as the cooling plates and plumbing, interfacing with the core structure.

In general, the benefits of the materials strategy employed herein are realized by manufacturing a substantial portion of the core structure out of low thermal expansion materials. The core structure includes, at a minimum, the stator assembly 200, rotor 100, and end plates 300, which together define a first combined core structure having a combined volume and a combined weight. The core structure may also include the linear translation rings 310, which together with the structures of the first combined core structure, defines a second combined core structure of manufactured material. The core structure may further include the vanes 120, which together with the structures of the second combined core structure, defines a third combined core structure of manufactured material.

The first combined core structure, comprising the stator assembly 200, rotor 100, and end plates 300, is substantially made of an iron-nickel based alloy, such as an Invar alloy. Preferably, the second combined core structure, comprising the stator assembly 200, rotor 100, end plates 300, and linear translation rings 310, is substantially made of an iron-nickel based alloy, such as an Invar alloy. The Invar alloy may be, for example, Super Invar or Invar 36, the characteristics of which were described in detail above. As stated above, Invar alloys are known to have remarkably low coefficients of thermal expansion (CTE). Indeed, the rate of thermal expansion is approximately one order of magnitude less than that of carbon steel at temperatures up to 200° C. Note that at present, Super Invar is a more expensive material, although its CTE is less than Invar 36.

As the term "substantially" implies, other metallic and/or ceramic materials can be combined with the Invar materials in the core structure, while still achieving the non-contacting sealing design throughout the operating temperature range of the machine. The term "substantially" as used herein is not subject to precise percentage boundaries. For example, at one end of the range, if the stator assembly 200, rotor 100, and end plates 300 were entirely made of discrete Invar (i.e., about 100% Invar by volume and about 100% Invar by weight), that certainly qualifies as substantial in the context of this invention. However, the lower percentage range is less precise, and is determined by selecting the minimum requisite Invar material compositional structure to effectively achieve the thermal and mechanical design goals for the noncontact sealing features of the present invention. More specifically, this minimum percentage is based on the coefficient of thermal expansion (CTE) of the combined "Invar/other material" structure, with a goal of achieving the proper CTE for the component to function within the clearance parameters of the present invention (defined later in the specification). This minimum percentage can be confirmed by routine experimentation based on the theoretical calculations of the thermal expansion properties of the combined "Invar/other material" structure. Based on calculations done to date, the lower percentage for the first, second or third combine core structures is about 60% by volume of the combined core structure material, and about 75% by weight of the combined core structure material, although the percentages may vary or be even lower, depending on the placement and thermal expansion properties of the combined materials.

For example, as noted immediately above, the CTE of Invar is approximately one-tenth, or one order of magnitude less than that of carbon steel. Accordingly, if approximately 5% of the component were comprised of discrete carbon steel or similar metal, the CTE for the component would change somewhat, but could still function properly within the clearance parameters of the present invention. On the other hand, if approximately 77% of the component were comprised of discrete carbon steel or similar metal, the CTE for the component would change greatly, and would not function properly within the clearance parameters of the present invention.

Note further that the component percentages discussed above refer to discrete Invar combined with a discrete metal or metals, and do not refer to blended combinations where the Invar and other metal(s) are melted to form a homogeneous substance. In such cases, the low CTE of the Invar material would be compromised. One of ordinary skill in the art could readily determine, without undue experimentation, the amount of non-Invar metal that could be used in these components to achieve the desired clearances, after balancing certain parameters such as cost and sealing performance.

In addition to the stator assembly 200, rotor 100, and end plates 300, it is preferable that the vanes 120 and linear translation rings 310 are made of Invar as well. The vanes 120 and linear translation rings 310 may be comprised of the same Invar as used in the stator assembly 200, rotor 100, and end plates 300, but need not be. Here again, one of ordinary skill in the art would understand that the higher-cost Super Invar material may be used for the vanes and still be cost effective, since the total material required for the vanes 120 is much less than the other stated components. Preferably, the third combined volume, comprising, the stator assembly 200, rotor 100, end plates 300, linear translation rings 310, and plurality of vanes 120, is substantially made of an iron-nickel based alloy, such as an Invar alloy. Alternatively, the vanes 120 may be made of a high fracture-toughness, low expansion ceramic such as, for example, silicon nitride, sialon, silicon carbide, or NZP (sodium zirconia phosphorous) class ceramics.

As described above, the design employs roller bearings to reduce friction between certain components of the engine as they move relative to each other, and to provide precise low wear guidance for the rotating components and respective clearances. The components should thus be composed of a suitably hard material to provide a hard surface for the roller bearings to roll on without causing significant wear to the component. However, Invar-class alloys are relatively soft compared to, for example, the hardened-steel or carbide materials, and components manufactured from such Invar-class alloys would generally be unsuitable for use where a rolling interface is desired.

Therefore, for any component comprising Invar, hard bearing pad inserts should be fixed to the Invar component at any location along the surface requiring a rolling interface with the Invar surface. By way of example, and not by limitation, the bearing pad inserts may be composed of hardened-steel or carbide. The bearing pad inserts may be attached by any suitable means, but preferably, the bearing pad inserts are brazed to the Invar component. The advantage of brazing is that only one surface, the top surface confronting the bearings, needs to be tightly controlled, while mechanical attachment would usually require control of two surfaces: the top surface and the interface surface between the insert material and the Invar material. The bearing pad inserts may be provided in appropriate recesses in the surface of the Invar component so that the insert and Invar surface are planar, or if clearances permit, the bearing pad inserts may be attached to the Invar surface. Such hard bearing inserts should not, however, significantly alter the low thermal expansion properties of the Invar-class alloys.

The bearing pad inserts provide certain advantages. First, they provide a hard surface for the bearings to ride on, without having to construct the Invar component out of this same material. Second, the bearing pad inserts can be replaced without having to replace the entire Invar component, thereby improving economy of operation.

Figure 9:
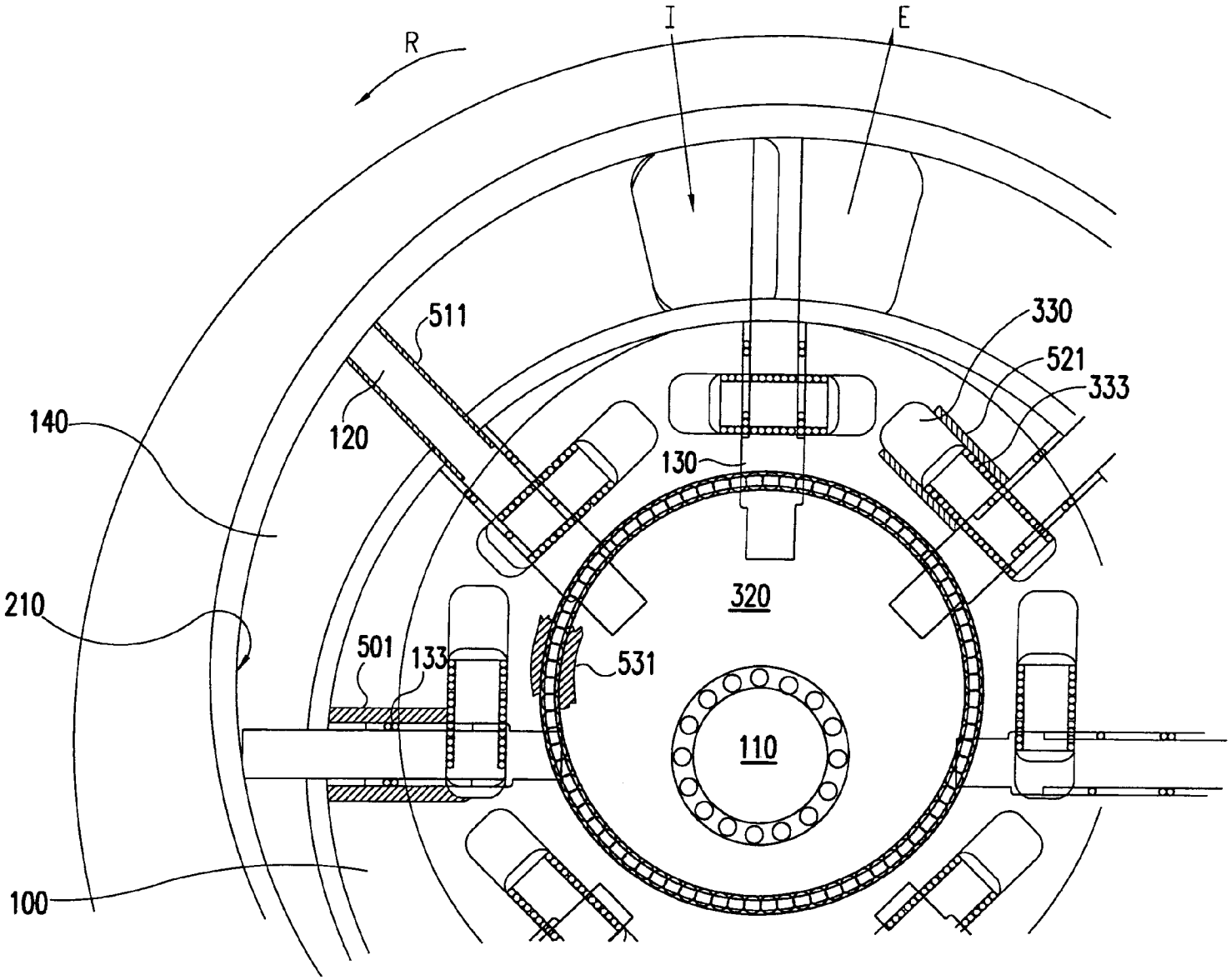
FIG. 9 is an enlarged view of a portion of FIG. 2 illustrating certain bearing pad insert locations of a preferred embodiment of the present invention.

With reference to FIG. 9, bearing pad inserts may be provided at many portions of the machine, and for simplicity and ease of illustration, only representative bearing pad inserts or portions thereof are shown. For example, bearing pad inserts 501 may be employed adjacent to the respective sides of each vane slot 130 to provide a bearing pad material more suited for this function than the primary Invar rotor material. The bearing pad inserts 501 contact the roller bearings 133 disposed between the vanes 120 and the radial vane slots 130. Hard bearing inserts 511 may also be fixed to the vanes 120 if the vanes were comprised of Invar. Again, the bearing pad inserts 511 contact the roller bearings 133 disposed between the vanes 120 and the radial vane slots 130. As shown in FIG. 9, other locations for the hard bearing inserts include: hard bearing inserts 521 adjacent the linear channels 330, which contact the roller bearings 333 disposed between the vane tabs 126 and the linear channels 330, and hard bearing inserts 531 adjacent the end plate hub 320 that the linear translation ring 310 spins around. Moreover, as shown in FIG. 4, hard bearing inserts 541 may be fixed to one or more surfaces of the vane tabs 126, which contact the roller bearings 333 disposed between the vane tabs 126 and the linear channels 330. As shown in FIG. 8, hard bearing inserts 551 may be fixed to the linear segments 148, which contact roller bearings disposed between the vane tab 126 and the linear segment 148. In addition, hard bearing inserts 561 may be provided adjacent the rotor thrust bearing 170 (see FIG. 5), and the end plate thrust bearing.

In a preferred embodiment, a combination of thermally conductive Invar alloys for the stator and rotor cores, and thermally insulating, low expansion ceramic stator insert(s), are employed to maintain proper dimensions and clearances, while ensuring the requisite toughness and reliability. Optionally, the Invar stator inserts can be replaced with sprayed zirconia. Also, Invar inserts could also be used in the flame pocket 260, or in the end plates 300, in which case the end plates inserts would mimic the crescent shape formed between the rotor outside diameter and the stator cavity 210 as best seen in FIG. 2.

As shown in FIG. 2, insulation liners 211, conforming to the stator cavity 210 of the stator assembly 200, are of near-zero expansion, low thermal conductivity, low modulus, high compressive strength ceramic materials such as, for example, materials of the class of NZP ceramics, such as sodium zirconia phosphate, calcium magnesium zirconia phosphate, and barium zirconium phosphate. Such NZP class ceramics are commercially available. The liners 211 may be attached to the stator assembly 200 by any suitable means. Alternatively, the liner material may be heated until forming a plasma, whereby it is then sprayed onto the stator assembly 200. While the liners 211 are preferable, they are optional.

Using Invar in the stator assembly 200, with its low CTE, in combination with the near-zero expansion ceramic liners 211, reduces or eliminates the problems traditionally associated with the interface of such near-zero expansion ceramic materials and the typical engine metal materials, which have different rates of thermal expansion or contraction over a wide range of operating temperatures. More specifically, when using the near-zero expansion ceramic materials and the typical engine metal materials, the CTE's of the respective materials differ greatly, which causes problems at the interface between the two materials. Replacing the typical engine metal material with a low CTE Invar alloy throughout the core structure, provides an engine where the CTE of the near-zero expansion ceramic materials closely approximates the CTE of the Invar material, and thus the interface problems are reduced or eliminated.

As described above, the use of the low thermal expansion Invar alloys allow extremely small sealing clearances to be maintained at important locations in the vane engine design described herein. From a performance standpoint, such sealing clearances are linearly scalable with the size of the engine. In other words, if we assume a certain size engine has a tip sealing clearance of 1 mil (0.001"), then an engine ten times as large could have a tip sealing clearance of about ten mils (0.01") and obtain comparable sealing performance. An engine that is ten times larger produces about 100 times more power and has about 1000 times more cell volume. The larger engine would spin at about one-tenth the rpm to produce the same tangential velocity and internal stresses, and thus the tip clearances could be about ten times larger for similar sealing performance.

In the following clearance discussions, the size of the engine and the clearances are described with reference to the vane cell height at intake. The vane cell height H at intake is determined by the difference in extension of a vane between its maximum extension from the rotor and its maximum retraction into the rotor ($Ch_{max}$). This cell height will, of course, decrease during compression. See, for example, the differing cell heights represented by the locations $H_1$ and $H_2$ in FIG. 2. Therefore, in the discussions below, the indicated clearances are proportionate to the maximum vane cell height ($Ch_{max}$). One of ordinary skill in the art would understand that a different reference may be used to characterize the clearance, for example, the rotor diameter or the rotor circumference, which are easily derived mathematically from the vane cell height and geometry.

In the following discussion, the more significant clearances will first be set forth, with the synergistic advantages and features of the clearances being described thereafter. Recall that such clearances are scalable with engine size as described above.

Figure 10A:
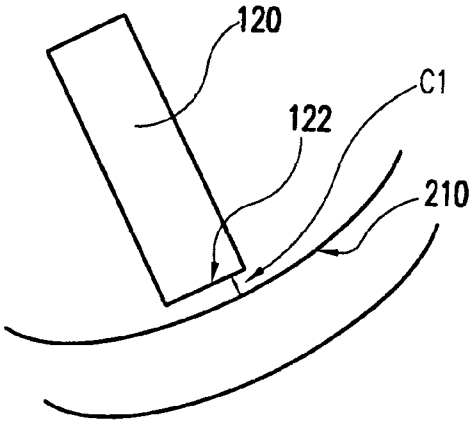

One of the more apparent clearances to achieve non-contact sealing is the radial tip clearance C1 between the vane tip 122 and the stator cavity 210 as shown in FIG. 10A, the dimensions of which have been exaggerated and distorted to better illustrate the features of the invention. The radial tip clearance C1 should be less than 0.001" per 1" of maximum chamber height ($Ch_{max}$) at the intake (<0.001"/1" ($Ch_{max}$)), and preferably, <0.0005"/1" ($Ch_{max}$)

While the above radial tip clearance C1 provides a non-contact seal along the upper radial extent of the vane cell 140 or chamber, a second significant clearance is the axial seal clearance between each axial side (or end) of the vane 120 and the axial extent of the vane cell 140 or chamber. The axial extent of the vane cell 140 is approximately equal to the axial width of the stator assembly 200, and in operation, the axial extent of the vane cell 140 is bounded on either side by an end plate 300. This axial vane-chamber clearance C2 (FIG. 10B) on each axial side of the vane 120 should be <0.001"/1" ($Ch_{max}$), and preferably <0.0005"/1" ($Ch_{max}$).

Figure 10C:
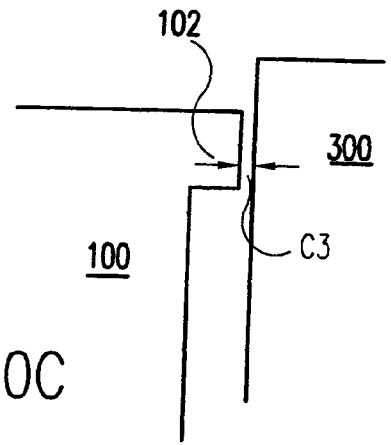

A third significant clearance is the axial rotor seal-end plate clearance C3 (FIG. 10C) between the rotor axial sealing lip 102 and the respective end plate 300. This axial seal gap clearance C3 should be less than 0.0005"/1" ($Ch_{max}$), and preferably, <0.0002"/1" ($Ch_{max}$). As described above and shown in FIG. 5, to maintain the axial sealing lips 102 in close sealing proximity with the adjacent end plate 300, without excessive wear on the axial sealing lips 102, the thrust bearing 170 is disposed between the rotor 100 and each adjacent end plate 300. In this position, and when combined with the journal rotor shaft bearing, the thrust bearings 170 help maintain and balance the axial seal gap, i.e., the gap between the axial sealing lips 102 and the adjacent end plate 300.

A fourth significant clearance is the vane face-vane slot wall clearance C4 (FIG. 10D) between the azimuthal face of the vane 120 and the vane slot seal 131 of the vane slot wall 130, This azimuthal vane-vane slot seal clearance C4 should be less than 0.0005"/1" ($Ch_{max}$), and preferably, <0.0002"/1" ($Ch_{max}$).

The present invention achieves many distinct advantages by using the low thermal expansion Invar alloys to achieve and maintain the precise clearances as described above. First, since there is no contact between the vane tips 122 and the stator walls 210, no lubrication is required within the actual vane cells 140 or chambers of the design, thereby eliminating a pollution-generating, oil film while simultaneously permitting an increase in the stator wall temperatures, which in turn decreases heat transfer and increases fuel efficiency. Also, the power density is increased by permitting an increase in tangential tip velocities, and thus flow rates.

Second, the present invention allows one to tightly control all non-contact seal clearances without high-wear, seal-controlling components such as gears (e.g., Wankel engine), while using roller bearings, which do not require a heavy oil film. Again, a heavy oil film, as used in a piston engine, for example, would defeat the idea of non-contact sealing, that is, to remove any pollution-generating oil film while raising the wall temperatures which were necessarily cooled by the oil film. The increased wall temperatures reduce heat transfer while increasing fuel efficiency.

Third, the extremely high power density engine design described herein means less material is required, which in turn makes the engine employing these higher cost Invar alloys and ceramic materials more cost-effective overall.

Fourth, the very low mechanical and thermal stresses throughout the design allow the low thermal expansion properties of the Invar alloys to be exploited throughout an internal combustion engine design, which heretofore was impractical due to the fact that the Invar alloys are generally too weak for use in many of the components of conventional internal combustion and turbine engines. The low stress environment allows the rigid Invar alloys to be used in a non-contact sealing design. The low mechanical and thermal stresses are a product of the rigid non-contact geometry combined with the lean mixture employed in the engine.

Fifth, since nearly the entire core structure of the machine can be made of Invar alloys, virtually no differential expansion problems will occur at differing ambient and operating temperatures.

Sixth, the present invention practically and effectively cools all Invar components so that the bulk of the metal does not exceed its effective low-expansion operating range.

Seventh, this engine design allows for the major components to be comprised of Invar alloys, but which also employ hard bearing inserts to provide a suitable rolling surface for roller bearings employed in the design. Moreover, the hard bearing inserts do not significantly alter the low thermal expansion properties of the Invar alloys.

Eighth, by allowing roller bearings to be used in the non-cont act engine design, the mechanical friction in the engine is greatly reduced, especially at partial power settings.

Finally, and most preferably, is the overall synergistic effect achieved by combining the qualities of the all the above-identified advantages. The result is a unique engine geometry that is able to exploit low coefficient of thermal expansion Invar materials, to achieve and maintain precise non-contact sealing clearances. The resulting benefits are reduced pollution emissions, increased operating efficiency of the engine, and increased power density—all in a cost-effective design.

It will be apparent to those skilled in the art that various modifications and variations can be made in the system and method of the present invention without departing from the spirit or scope of the invention. Thus, it is intended that the present invention cover the modifications and variations of this invention provided they come within the scope of the appended claims and their equivalents.

What is claimed is:

1. A rotary vane pumping machine have a core structure and peripheral components interfacing with the core structure, the core structure comprising:

a stator assembly comprising an annular ring, the inner circumferential surface of the annular ring defining a contoured surface of a stator cavity;

a rotor spinning around an axis of a rotor shaft, the rotor shaft axis being a fixed rotational axis relative to the stator cavity, the rotor having a plurality of radial vanes slots and the rotor and stator being in relative rotation;

a plurality of vanes, each of the plurality of vanes sliding with at least one of a radial and axial component of vane motion within a corresponding radial vane slot of the rotor, and each of the plurality of vanes having side walls, a tip portion, and a base portion, the base portion having one or more tabs extending from at least one axial end of the vane;

a guidance device engaging the tabs to control radial movement of the vanes;

a first end plate adjacent a first axial side of the rotor; and a second end plate adjacent a second axial side of the rotor such that the rotor is located between the first and second end plates, wherein the rotor shaft extends through at least one of the first end plate and second end plate, wherein an outer circumferential surface of the rotor comprises an annular sealing lip extending axially toward respective of the first end plate and the second end plate, wherein the plurality of vanes, the stator cavity, and the rotor define a plurality of chamber cells, wherein the vane tip portion and the contour of the stator cavity are spaced apart by a radial clearance, wherein the stator assembly, rotor, first end plate and second end plate together define a first combined core structure, and wherein the first combined core structure is substantially comprised of an invar-class alloy.

2. The rotary machine of claim 1, wherein the one or more tabs are formed to be partially recessed in the side walls of respective vanes.

3. The rotary machine of claim 1, wherein the one or more tabs are formed to be flush with the side walls of respective vanes.

4. The rotary machine of claim 1, wherein the one or more tabs are formed to be retracted into the side walls of respective vanes.

5. The rotary vane pumping machine of claim 1, wherein at least one of the tabs is formed to be partially recessed in one of the side walls of a respective vane.

6. The rotary vane pumping machine of claim 1, wherein at least one of the tabs is formed to be flush with one of the side walls of a respective vane.

7. The rotary vane pumping machine of claim 1, wherein at least one of the tabs is formed to be retracted into one of the side walls of a respective vane.

8. The rotary machine of claim 1, further comprising a plurality of vane connectors, wherein pairs of radially-opposed vanes are connected by one or more of the vane connectors that are attached to the base portions of the pair of radially-opposed vanes.

9. The rotary machine of claim 8, wherein the vanes are wider than the vane connectors.

* * * * *